US010018958B2

(12) United States Patent
Takahashi

(10) Patent No.: US 10,018,958 B2
(45) Date of Patent: Jul. 10, 2018

(54) MISATTACHMENT PREVENTION DEVICE FOR IMAGE FORMING UNIT, IMAGE FORMING UNIT AND IMAGE FORMING APPARATUS

(71) Applicant: Oki Data Corporation, Tokyo (JP)

(72) Inventor: Keita Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/361,022

(22) Filed: Nov. 24, 2016

(65) Prior Publication Data

US 2017/0153596 A1 Jun. 1, 2017

(30) Foreign Application Priority Data

Nov. 27, 2015 (JP) ..... 2015-231440

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 15/0189; G03G 15/0886; G03G 15/087; G03G 15/0872; G03G 15/0834; G03G 15/0863; G03G 15/0836; G03G 15/0867; G03G 15/0868
See application file for complete search history.

(56) References Cited

U.S. PATENT DOCUMENTS

| | | | | |
|---|---|---|---|---|
| 8,818,246 | B2 * | 8/2014 | Kouroku | G03G 15/0189 399/258 |
| 9,482,988 | B2 * | 11/2016 | Hosokawa | G03G 15/0872 |
| 9,594,331 | B2 * | 3/2017 | Suiseki | G03G 15/0886 |
| 2008/0175629 | A1 * | 7/2008 | Eto | G03G 15/0875 399/262 |
| 2010/0329731 | A1 * | 12/2010 | Naoi | G03G 21/1896 399/111 |
| 2015/0139688 | A1 * | 5/2015 | Leemhuis | G03G 21/1604 399/110 |

FOREIGN PATENT DOCUMENTS

JP 2007-334252 A 12/2007

* cited by examiner

*Primary Examiner* — Clayton E Laballe
*Assistant Examiner* — Ruifeng Pu
(74) *Attorney, Agent, or Firm* — Muncy, Geissler, Olds & Lowe, P.C.

(57) ABSTRACT

A misattachment prevention device for an image forming unit includes multiple developer containing parts that contain individual color developers, and process parts each of which is capable to be engaged with any of the developer containing parts, and forms the image forming unit for an individual color by having one of the developer containing parts engaged, wherein (c) each of the process parts is provided with an intermediate locking member guide part in a place opposing the one of the developer containing parts, and (d) the intermediate locking member guide part is provided with an intermediate locking member that is locked with a locking part formed on the one of the individual developer containing parts, protruded from the intermediate locking member guide part to a side of an apparatus main body, and locked with a locked part formed on the apparatus main body.

20 Claims, 22 Drawing Sheets

(After Rotation)

(Before Rotation)

MISATTACHMENT PREVENTION DEVICE FOR IMAGE FORMING UNIT, IMAGE FORMING UNIT AND IMAGE FORMING APPARATUS

CROSS REFERENCE TO RELATED APPLICATIONS

This application claims priority under 35 USC 119 to Japanese Patent Application No. 2015-231440 filed on Nov. 27, 2015 original document, the entire contents which are incorporated herein by reference.

TECHNICAL FIELD

This invention relates to an image forming unit misattachment prevention device, an image forming unit, and an image forming apparatus.

BACKGROUND

Conventionally, an image forming apparatus such as a printer, a copier, a facsimile machine, or a multifunction machine, for example an electrophotographic color printer is provided with image forming units of multiple colors, and in each of the individual image forming units, a toner image of each color is formed on the surface of a photosensitive drum, the toner image is sequentially transferred onto a sheet by a transfer roller to form a color toner image, and the color toner image is fused to the sheet in a fuser.

By the way, because the individual image forming units are formed in the same shape due to functional, structural, and costwise factors, they need to be attached to the positions assigned by the toner color in the printer main body, that is, the apparatus main body.

Then, an engaging member and an engaged member are arranged on each of the image forming units and the apparatus main body, respectively, and if the engaging member and the engaged member do not match, the image forming unit cannot be attached to the apparatus main body (e.g., see Patent Document 1).

RELATED ART

[Patent Doc. 1] Japanese Laid-Open Patent Publication 2007-334252

However, in the conventional printer, an engaging member needs to be formed for each of the image forming units, and the image forming units need to be managed, therefore the printer cost increases.

The objective of this invention is to provide an image forming unit misattachment prevention device, an image forming unit, and an image forming apparatus that can solve the problems of the conventional printer and allow attaching multiple image forming units precisely to the positions assigned by the developer colors in the apparatus main body and lowering the cost.

SUMMARY

A misattachment prevention device for an image forming unit including (a) multiple developer containing parts that contain individual color developers, each of the developer containing parts containing a different color developer from the other developer containing parts, and (b) process parts each of which is capable to be engaged with any of the developer containing parts, and forms the image forming unit for an individual color by having one of the developer containing parts engaged.

Each of the process parts is provided with an intermediate locking member guide part in a place opposing the one of the developer containing parts.

The intermediate locking member guide part is provided with an intermediate locking member that is locked with a locking part formed on the one of the individual developer containing parts, protruded from the intermediate locking member guide part to a side of an apparatus main body, and locked with a locked part formed on the apparatus main body.

In this case, a process part shared by individual developer containing parts is provided with an intermediate locking member guide part in a place opposing the developer containing part.

The intermediate locking member guide part is provided with an intermediate locking member that is locked with a locking part formed on each developer containing part and protruded from the intermediate locking member guide part to the side of the apparatus main body.

Therefore, by having the intermediate locking member and a locked part formed on the apparatus main body locked with each other, the image forming unit can be precisely engaged at the position assigned by the developer color in the apparatus main body.

Then, because the process part can be shared by multiple developer containing parts, there is no need to form a process part for each of the image forming units or manage the image forming units, therefore the cost of the image forming apparatus can be lowered.

DETAILED DESCRIPTION OF THE PREFERRED EMBODIMENT(S)

Below, embodiments of this invention are explained in detail referring to drawings. In this case, explanations are given on electrophotographic printers as image forming apparatuses.

Figure 2:
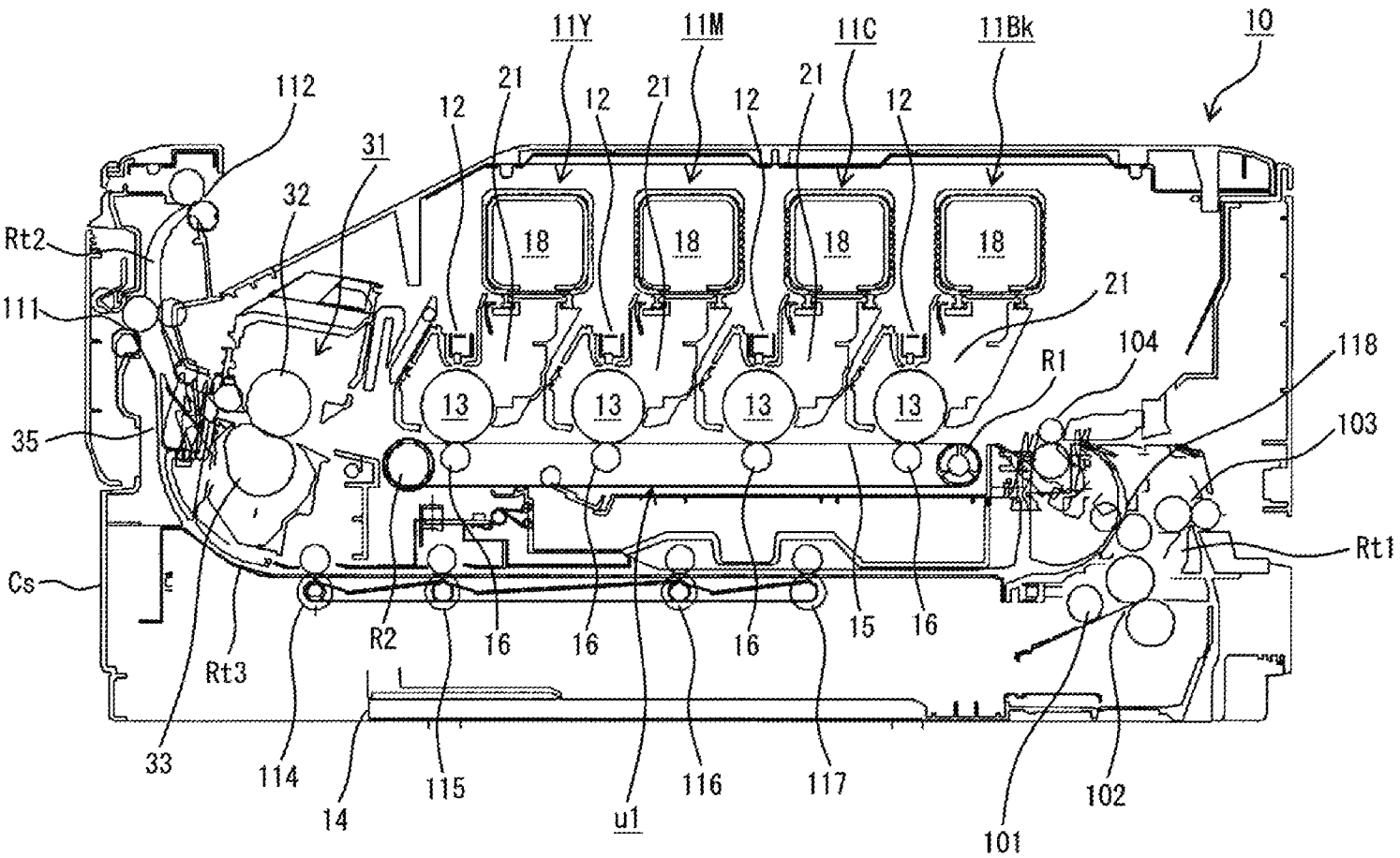
FIG. 2 is a conceptual diagram of a printer in the first embodiment of this invention.

FIG. 2 is a conceptual diagram of a printer in the first embodiment of this invention.

In the figure, indicated as 10 is a printer, Cs is a chassis of the printer 10, and 11Bk, 11C, 11M, and 11Y are image forming units (ID units) of individual colors of black, cyan, magenta, and yellow that are detachably attached to the main body of the printer 10, that is, the apparatus main body. Each of the image forming units 11Bk, 11C, 11M, and 11Y is provided with a process part 21 and a toner cartridge 18 as a developer containing part that is detachably attached to the process part 21 and contains a toner as an individual color developer, and each process part 21 is provided with a photosensitive drum 13 as an image carrier, and a charging roller as a charging device, a development roller as a developer carrier, a cleaning device, etc. that are arranged around the photosensitive drum 13 and not shown. Then, an LED head 12 as an exposure device is arranged so as to be adjacent to each process part 21 and oppose the photosensitive drum 13

Note that a misattachment prevention device is constituted of multiple toner cartridges 18 that contain individual color toners, and the process parts 21 that are shared by the toner cartridges 18 and have the individual toner cartridges 18 attached to form the image forming units 11Bk, 11C, 11M, and 11Y of individual colors.

Also, indicated as 14 is a sheet cassette as a medium accommodating part that contains unshown sheets as a medium, and arranged rotatably at the leading edge of the sheet cassette are a sheet feeding roller 101 that forwards the sheets inside the sheet cassette 14 to a medium route Rt1 and a separation roller pair 102 that separates the sheets into single pieces. Then, indicated as 103 is a carrying roller pair that is arranged rotatably in the downstream side of the separation roller pair 103 on the medium carrying route Rt1 and carries a sheet forwarded to the medium carrying route Rt1, and 104 is a registration roller pair that is arranged rotatably in the downstream side of the carrying roller pair 103 on the above-mentioned medium carrying route Rt1 and corrects skew of the sheet by being temporarily stopped.

Further, indicated as u1 is a transfer unit that is arranged opposing the individual image forming units 11Bk, 11C, 11M, and 11Y in the downstream side of the registration roller pair 104 on the medium carrying route Rt1.

The transfer unit u1 is provided with a drive roller R1 arranged rotatably beneath the image forming unit 11Bk, a driven roller R2 arranged rotatably beneath the image forming unit 11Y, a transfer belt 15 stretched to run freely between the drive roller R1 and the driven roller R2, and transfer rollers 16 as transfer members arranged rotatably opposing the photosensitive drums 13 through the transfer belt 15.

Also, indicated as 31 is a fuser as a fuser device arranged in the downstream side of the image forming units 11Bk, 11C, 11M, and 11Y and the transfer unit u1 on the medium carrying route Rt1, and the fuser 31 is provided with a heat application roller 32 as a first fuser member, and a pressure application belt 33 as a second fuser member.

Then, indicated as 35 is a carrying route switching member as a medium reversing device that is arranged in the downstream side of the fuser 31 on the medium carrying route Rt1 for reversing the sheet when performing double side printing. When performing single side printing, the carrying route switching member 35 sends the sheet to a medium carrying route Rt2 formed in the downstream side of the carrying route switching member 35, and when performing double side printing, it sends the sheet to a medium carrying route Rt3 formed below the transfer unit u1.

On the medium carrying route Rt2, a carrying roller pair 111 that carries the sheet is rotatably arranged, and an ejection roller pair 112 that ejects the sheet to the outside of the apparatus main body is rotatably arranged in the downstream side of the carrying roller pair 111.

Also, arranged rotatably on the medium carrying route Rt3 are carrying roller pairs 114-118 for sending the reversed sheet to the medium carrying route Rt1.

Next, explained is the operation of the printer 10.

In each of the image forming units 11Bk, 11C, 11M, and 11Y, the photosensitive drum 13 is rotated by an unshown drive part, and the charging roller uniformly charges the surface of the photosensitive drum 13. Next, in an exposure process, the LED head 12 irradiates the photosensitive drum 13 with light corresponding to an image signal to form an electrostatic latent image as a latent image.

Then, the development roller develops the electrostatic latent image by having a toner adhere onto the photosensitive drum 13 to form a toner image as a developer image.

A single sheet is separated from the sheets accommodated in the sheet cassette 14 and forwarded to the medium carrying route Rt1 by the sheet feeding roller 101 and the separation roller pair 102, is carried by the carrying roller pair 103, has its skew corrected by the registration roller pair 104, and sent to between each of the image forming units 11Bk, 11C, 11M, and 11Y and the transfer unit u1 along with the running of the transfer belt 15. Then, the toner images on the individual photosensitive drums 13 are sequentially transferred to the sheet over one another, forming a color toner image on the sheet. Next, the sheet is sent to the fuser 31, and heat and a pressure are applied by the heat application roller 32 and the pressure application roller 33, thereby the color toner image is fused to the sheet, forming a color image.

Then, in the case of single side printing, the sheet with the color image formed is carried on the medium carrying route Rt2 by the carrying roller pair 111 and ejected to the outside of the apparatus main body by the ejection roller pair 112.

Also, in the case of double side printing, the sheet with the color image formed is reversed by the carrying route switching member 35, afterwards carried on the medium carrying route Rt3 by the carrying roller pairs 114-118, and sent to the medium carrying route Rt1 again.

By the way, if the individual image forming units 11Bk, 11C, 11M, and 11Y are formed and managed separately by the color toner, the cost of the printer 10 would increase.

Then, this embodiment is designed so that each of the image forming units 11Bk, 11C, 11M, and 11Y is formed of the process part 21 and the toner cartridge 18 that can be detachably attached to the process part 21, the process part 21 is shared by the toner cartridges 18, and the toner cartridges 18 are formed separately by the color toner.

Figure 3:
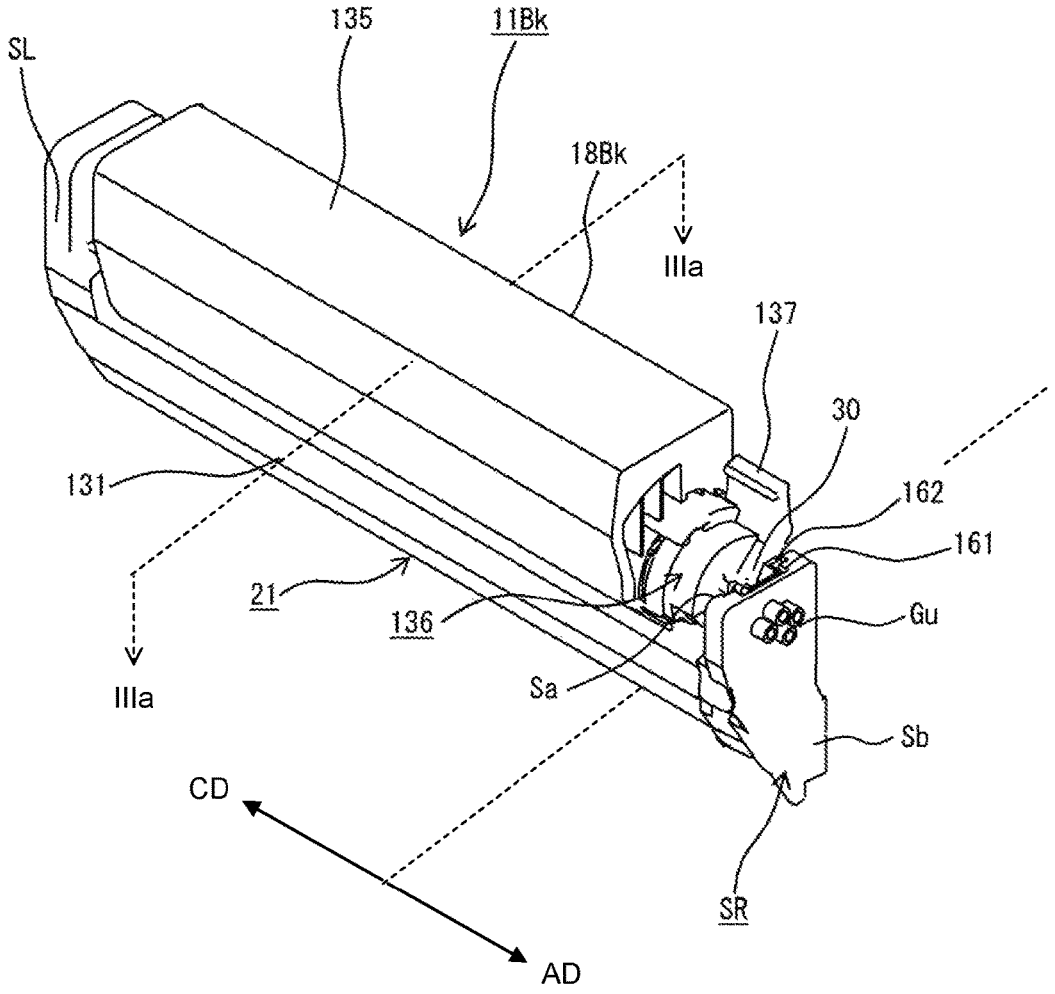
FIG. 3 is a perspective view of an image forming unit in the first embodiment of this invention.
Figure 4:
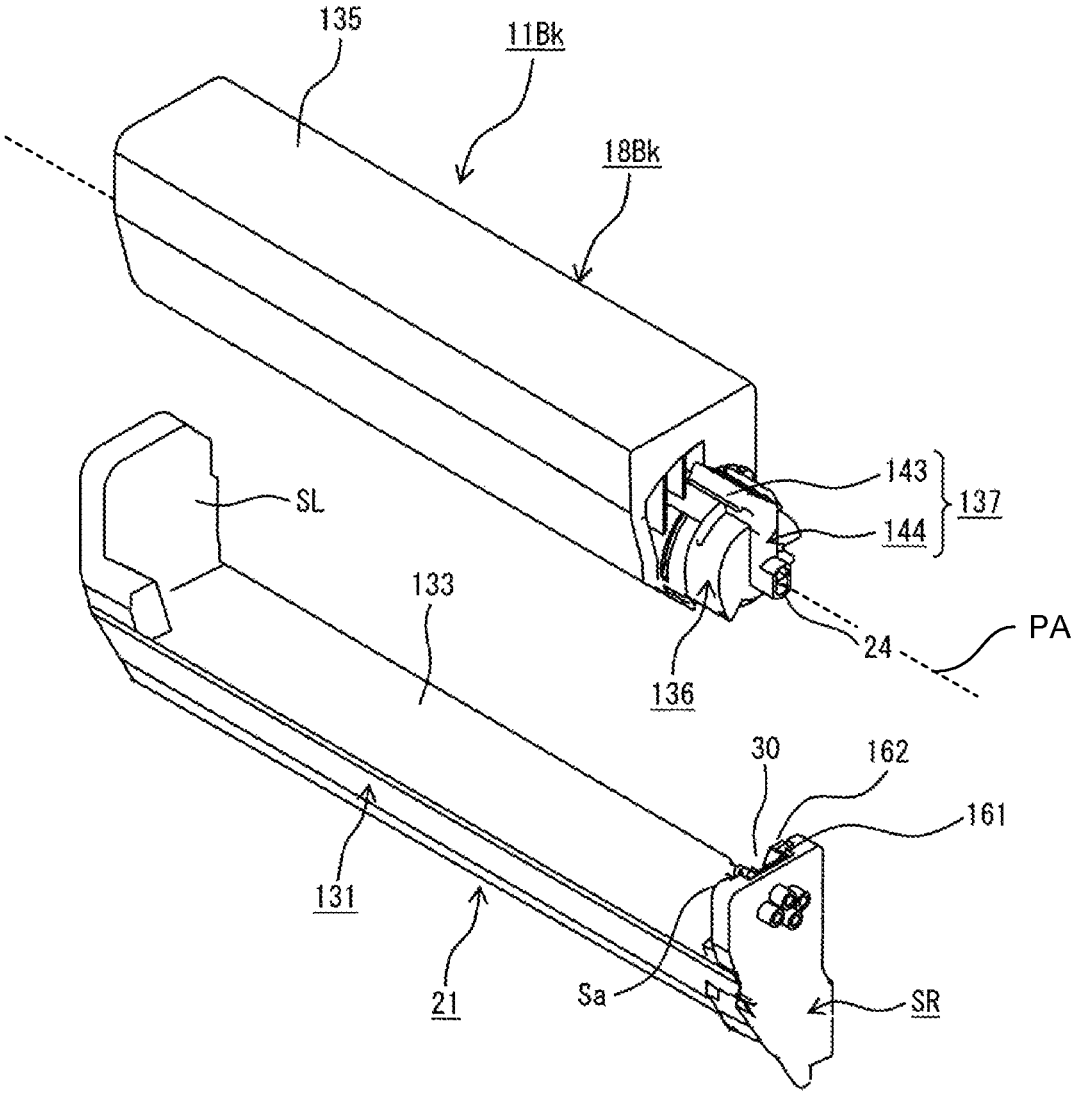
FIG. 4 is an exploded perspective view of the image forming unit in the first embodiment of this invention.
Figure 5:
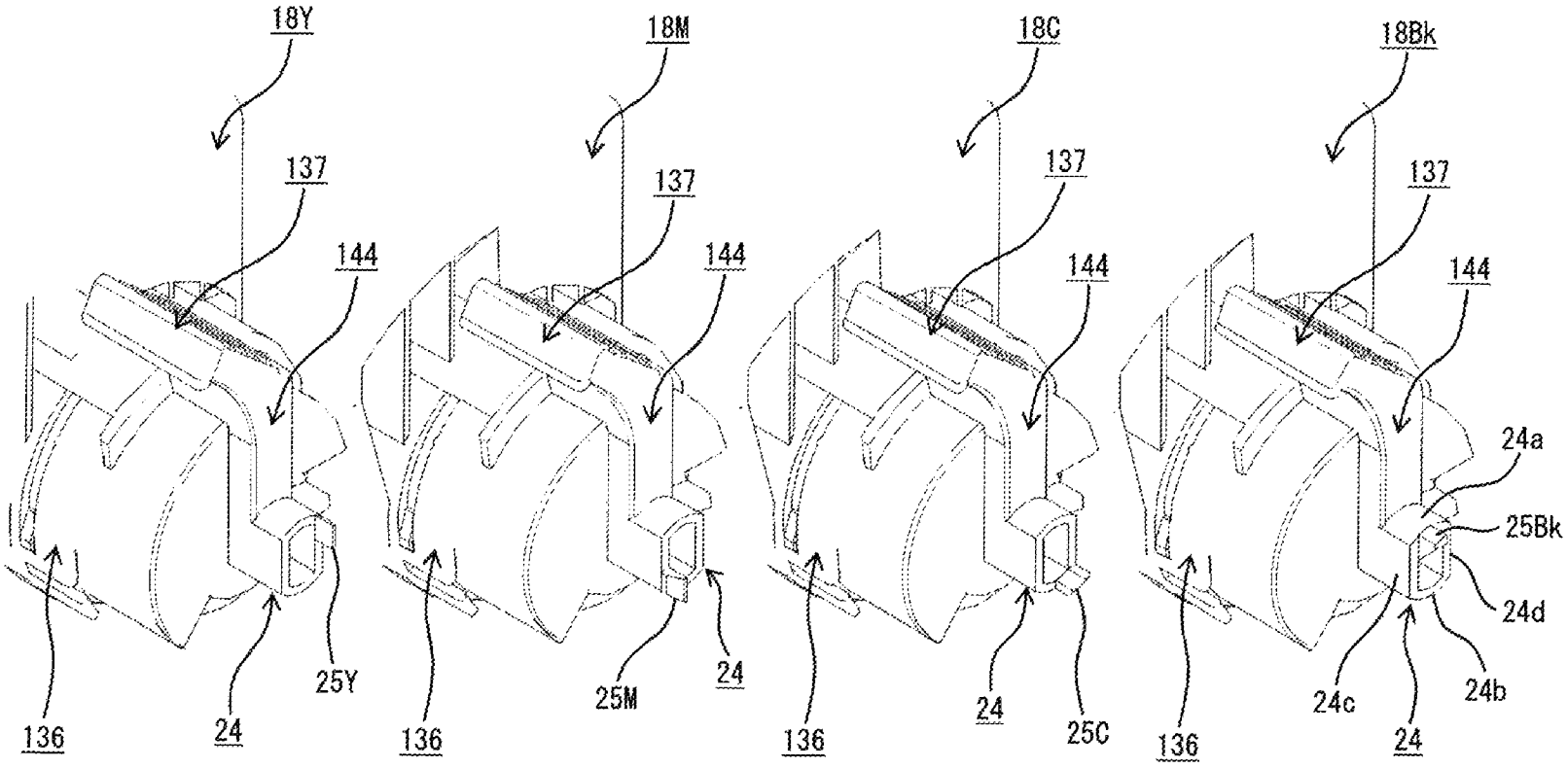
FIG. 5 is a main part perspective view of individual color toner cartridges in the first embodiment of this invention.
Figure 6:
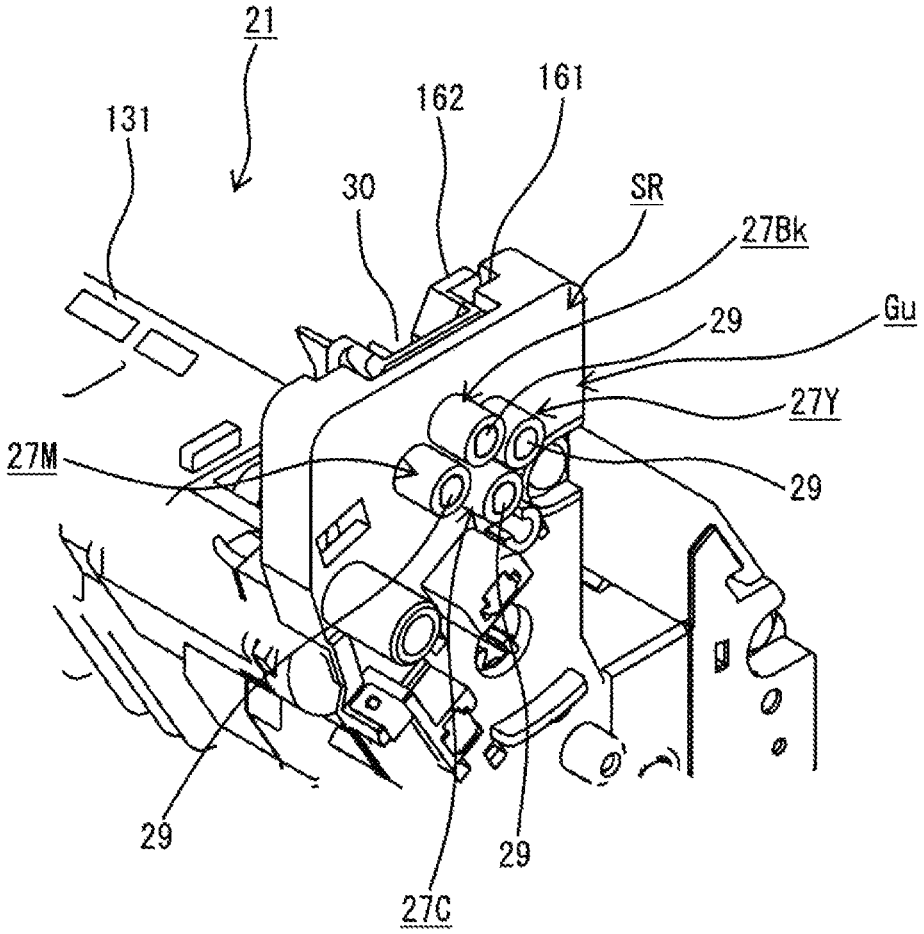
FIG. 6 is a main part enlarged view of the process part in the first embodiment of this invention.
Figure 7:
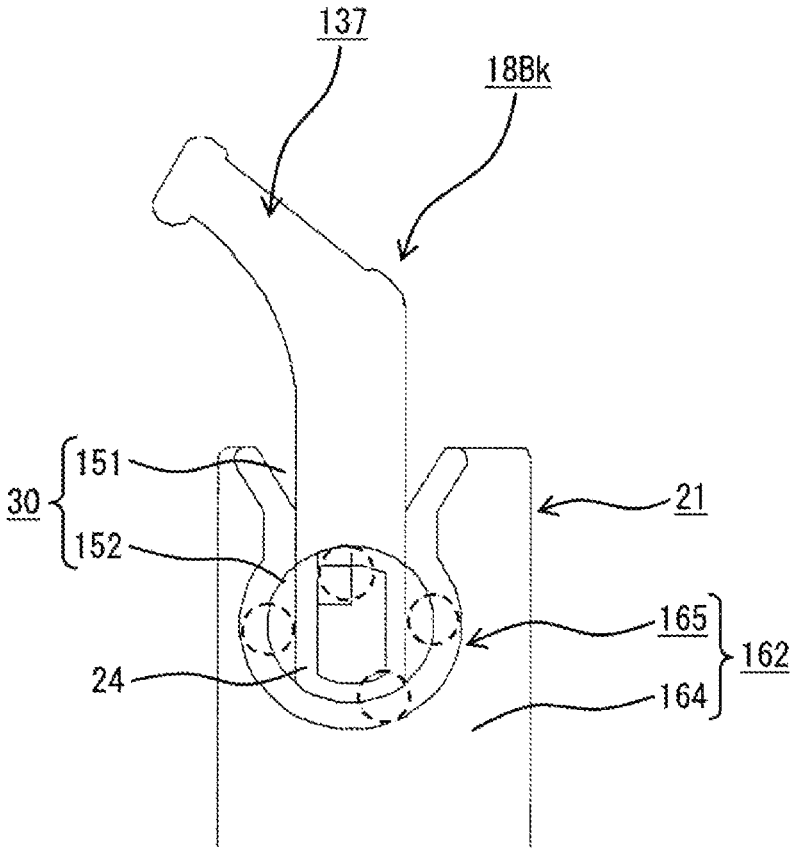
FIG. 7 is a diagram for explaining the relation between a fitting projection and a fitting recess in the first embodiment of this invention.

FIG. 3 is a perspective view of one of the image forming units in the first embodiment of this invention, FIG. 4 is an exploded perspective view of the image forming unit in the first embodiment of this invention, FIG. 5 is a main part perspective view of the individual color toner cartridges in the first embodiment of this invention, FIG. 6 is a main part enlarged view of the process part in the first embodiment of this invention, and FIG. 7 is a diagram for explaining the relation between a fitting projection and a fitting recess in the first embodiment of this invention. Note that shown in FIGS. 3 and 4 is the image forming unit 11Bk among the image forming units 11Bk, 11C, 11M, and 11Y. Also, for the convenience of explanation, the toner cartridges 18 containing black, cyan, magenta, and yellow color toners are indicated as toner cartridges 18Bk, 18C, 18M, and 18Y.

In the figures, indicated as 11Bk is one of the image forming units, 21 is the process part having a common structure for the image forming units 11Bk, 11C, 11M, and 11Y, and 18Bk, 18C, 18M, and 18Y are the toner cartridges.

The process part 21 accommodates one of the photosensitive drums 13 (FIG. 2) etc. and is provided with a process part main body 131 that extends in the axial direction of the photosensitive drum 13, a side plate SR formed standing up toward the upper direction at one end part of the process part main body 131, in this embodiment at the right-side end part when facing the fuser 31, and a side plate SL formed standing up toward the upper direction at the other end part of the process part main body 131, in this embodiment the left-side end part when facing the fuser 31. Then, the toner cartridge 18Bk, 18C, 18M, or 18Y is attached to the process part 21 by being inserted between the side plates SR and SL and placed on the process part main body 131. When toner cartridge 18 is properly equipped with process part main body 131, a detecting device provided in the side plate detects that toner cartridge 18 is set properly. The detecting device is composed with a sensor and a processor.

Formed extending in the axial direction of the photosensitive drum 13 on the upper face 133 of the process part main body 131 is an supply port for supplying into the process part main body 131 a toner ejected from an ejection port of the toner cartridge 18Bk, 18C, 18M, or 18Y.

The toner cartridge 18Bk, 18C, 18M, or 18Y is provided with an outer case 135 that contains a toner, an inner case of a cylindrical shape arranged pivotably centering on a pivot axis extending in the longitudinal direction inside the outer case 135, and a lever holding part 136 formed connected with the inner case at one end part of the outer case 135, in this embodiment at the end part on the side plate SR side, and a lever 137 as an operation part is formed on the lever holding part 136. The pivot axis is denoted with PA in FIG. 4. The lever 137 extends in a direction parallel to the pivot axis of the inner case and is provided with a grasping part 143 formed protruding outwards in the radial direction from the outer circumferential face of the lever holding part 136, and an arm part 144 formed protruding toward the side plate SR from an end part of the grasping part 143. Inside the inner case, corresponding to the supply port formed on the process part main body 131 the ejection port is formed for ejecting a toner from the toner cartridge 18Bk, 18C, 18M, or 18Y. When the lever 137 is placed in its initial position as shown in FIGS. 4 and 5, the positions of the ejection port and the supply port are not aligned so that the toner inside the toner cartridge 18Bk, 18C, 18M, or 18Y is not sent to the process part 21, and once the lever 137 is rotated as shown in FIG. 3, the positions of the ejection port and the supply port are aligned so that the toner inside the toner cartridge 18Bk, 18C, 18M, or 18Y is sent to the process part 21. In FIG. 3, direction AD that is toward lower right in the sheet is defined as a side of the apparatus main body. Direction CD that is toward upper left is defined as a side of the cartridge. Direction AD may be determined as a direction that is along the pivot axis PA of the cartridge and away from the cartridge.

Figure 3B:
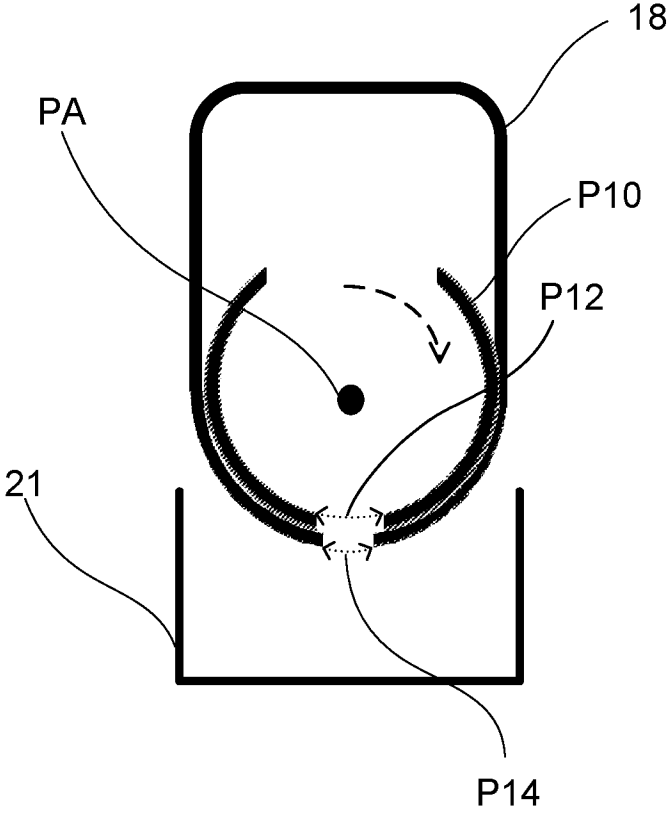
FIGS. 3A and 3B are sectional views taken IIIa-IIIa line in FIG. 3.
Figure 3A:
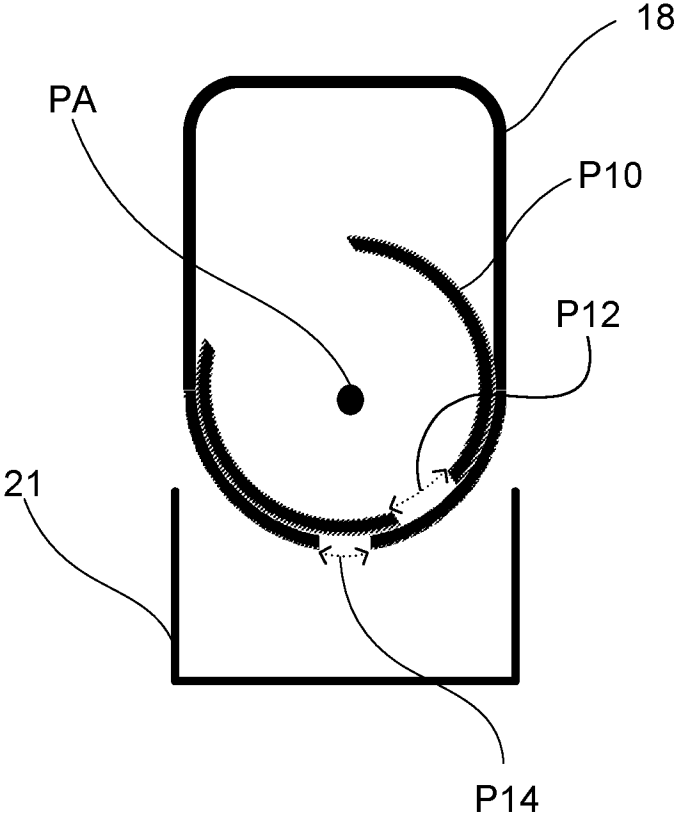

FIG. 3A and FIG. 3B illustrates functional charts with respect to inner case P10. In FIG. 3A, since ejection port P12 does not meet supply port P14, the toner does not go through these ports. FIG. 3B illustrates inner case P10 having rotated in the clockwise direction around pivot axis PA. Since ejection port P12 meets supply port P14, the toner inside the cartridge goes through these ports to reach the process part 21.

Then, a fitting projection 24 as an engaging part is formed protruding toward the side plate SR on the part of the pivot axis of the lever holding part 136 on the arm part 144.

Also, formed on a face Sa of the side plate SR opposing the toner cartridge 18Bk, 18C, 18M, or 18Y is a recess 161 having a prescribed shape, and attached to the recess 161 is a fitting projection guide 162 as an engaging part guide member for guiding the fitting projection 24 when moving the toner cartridge 18Bk, 18C, 18M, or 18Y downwards for attaching it to the process part 21. The fitting projection guide 162 is provided with a flat plate part 164 and an enclosure 165 formed standing up from the plate part 164, and formed inside the enclosure 165 is a fitting recess 30 as an engaged part to accommodate the fitting projection 24.

Each of the fitting projections 24 is made of a rectangular cylindrical body provided with two arc-shape sides 24*a* and 24*b* positioned at the top and the bottom when the lever 137 is placed in its initial position, and two flat-shape sides 24*c* and 24*d* positioned at the right and the left connecting the ends of the sides 24*a* and 24*b*, and locking protrusions 25Bk, 25C, 25M, 25Y are formed protruding on different positions of the sides 24*a*-24*d* for the toner cartridges 18Bk, 18C, 18M, and 18Y, respectively.

That is, in the toner cartridge 18Bk the locking protrusion 25Bk is formed on the left-side rim part of the side 24*a* when viewed from the side plate SR side, in the toner cartridge 18C the locking protrusion 25C is formed on the right-side rim part of the edge 24*b* when viewed from the side plate SR side, in the toner cartridge 18M the locking protrusion 25M is formed on the lower-side rim part of the edge 24*c* when viewed from the side plate SR side, and in the toner cartridge 18Y the locking protrusion 25Y is formed on the upper-side rim part of the edge 24*d* when viewed from the side plate SR side.

Also, the fitting recess 30 is formed facing the upper end of the enclosure 165, and is provided with an introduction part 151 that accepts the fitting projection 24 when the toner cartridge 18Bk, 18C, 18M, or 18Y is moved downwards to be attached to the process part 21, and a fitting projection accommodating part 152 that is formed below the introduction part 151, accommodates the fitting projection 24, and pivotably supports the fitting projection 24 together with the lever 137.

Then, in a place of the process part 21 opposing the toner cartridge 18Bk, 18C, 18M, or 18Y, in this embodiment on a face Sb of the side plate SR opposing the apparatus main body, a post guide unit Gu as an intermediate locking member guide part is arranged. The post guide unit Gu is made of cylindrical guides 27Bk, 27C, 27M, and 27Y formed protruding toward the apparatus main body corresponding to the toner cartridges 18Bk, 18C, 18M, and 18Y, holes 29 are formed that penetrate from the face Sa side to the face Sb side, and a post 26 (FIG. 1) as an intermediate locking member mentioned below is arranged in each of the holes 29 in a manner allowing free advance and retreat.

Figure 1:
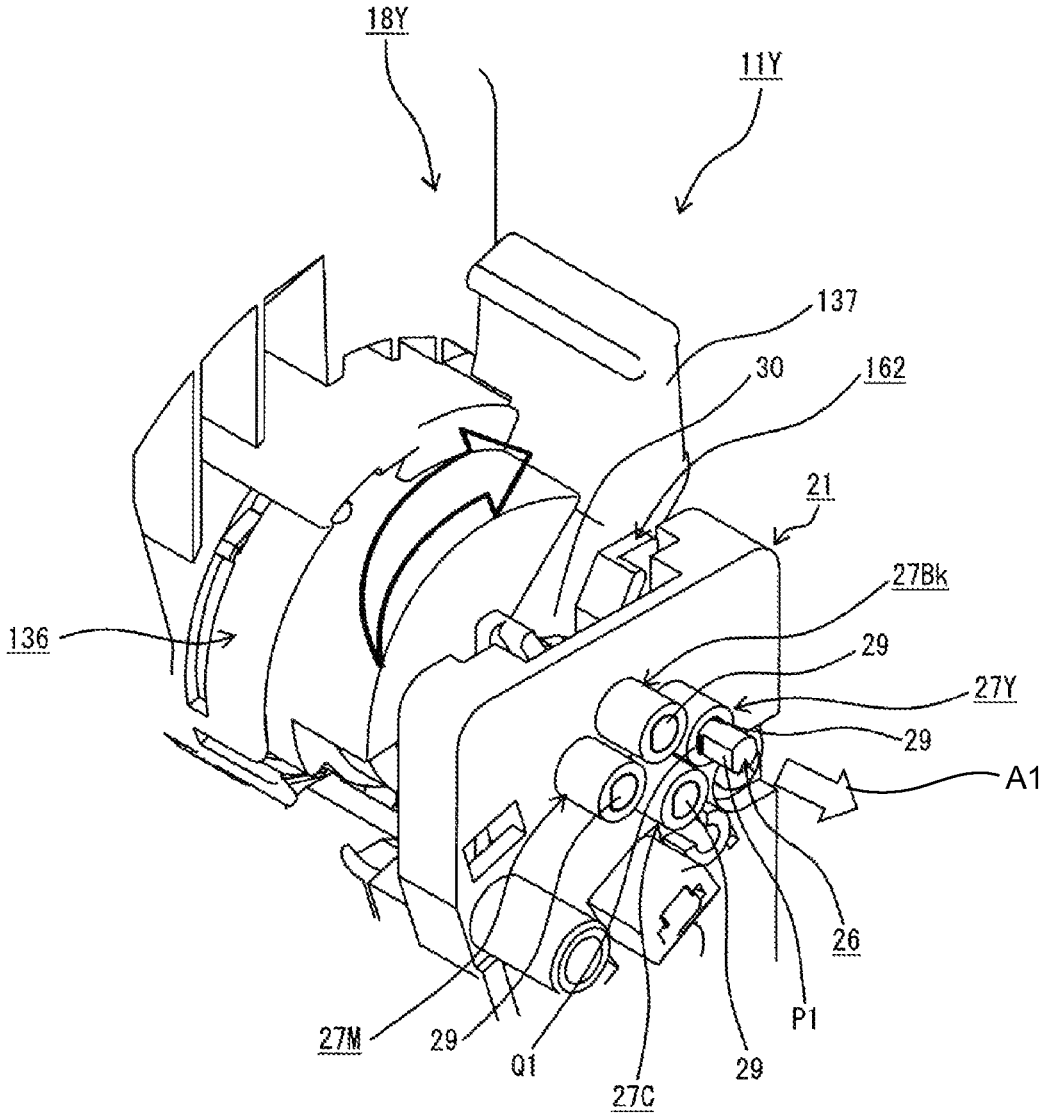
FIG. 1 is a diagram for explaining the state of a post when a yellow toner cartridge is attached to (or engaged with) a process part in the first embodiment of this invention.

Once the toner cartridge 18Bk, 18C, 18M, or 18Y is attached to the process part 21, the post 26 is protruded toward the apparatus main body. In FIG. 1, the direction to protrude is shown with a straight short arrow A1 that indicates from the left to the slightly obliquely right downward. In FIG. 3, the right side from the side plate SR means a side of the apparatus main body and an apparatus main body direction (AD). The left side from the side plate SR means a side of the developer containing part and a developer containing part direction (CD).

Next, explained is the operation of the fitting projection 24 when the toner cartridge 18Bk, 18C, 18M, or 18Y is attached to the process part 21.

Figure 8:
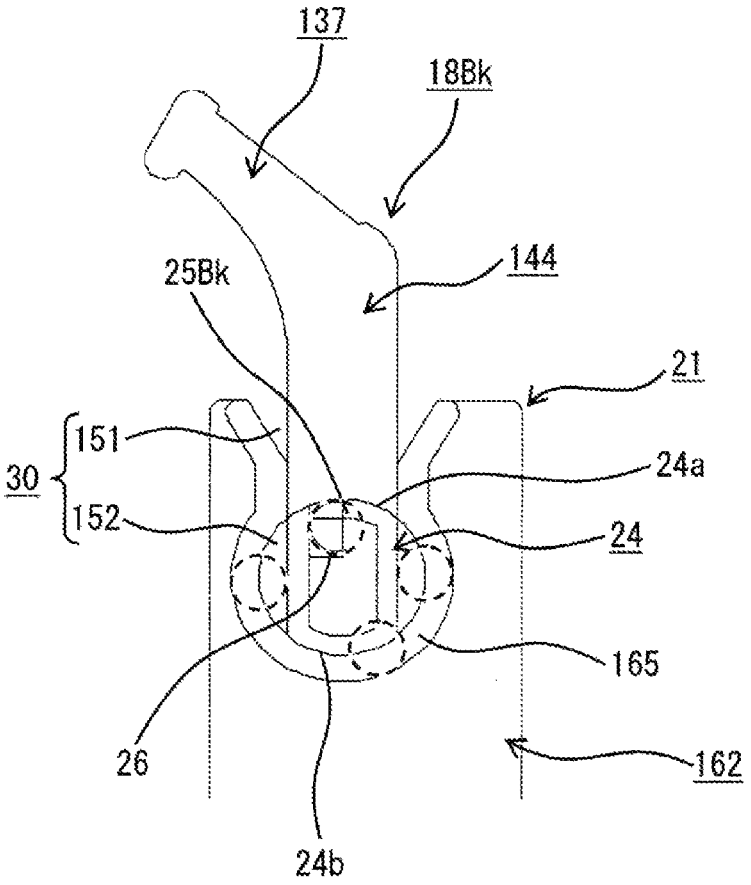
FIG. 8 is a diagram for explaining the locking state between a locking protrusion and the post when a black toner cartridge is attached to (or engaged with) the process part in the first embodiment of this invention.
Figure 9:
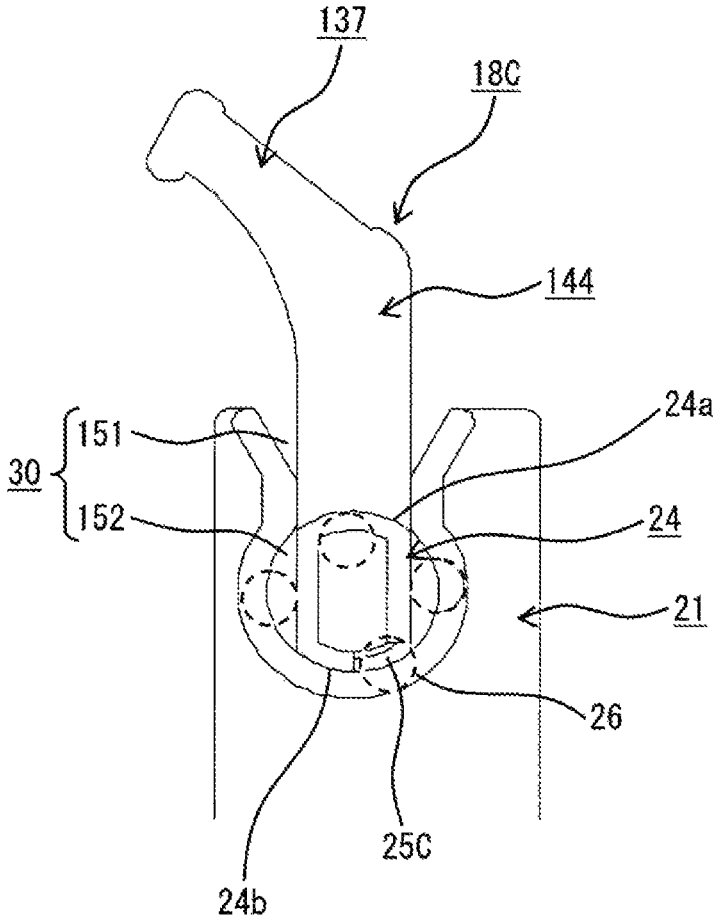
FIG. 9 is a diagram for explaining the locking state between the locking protrusion and the post when a cyan toner cartridge is attached to (or engaged with) the process part in the first embodiment of this invention.
Figure 10:
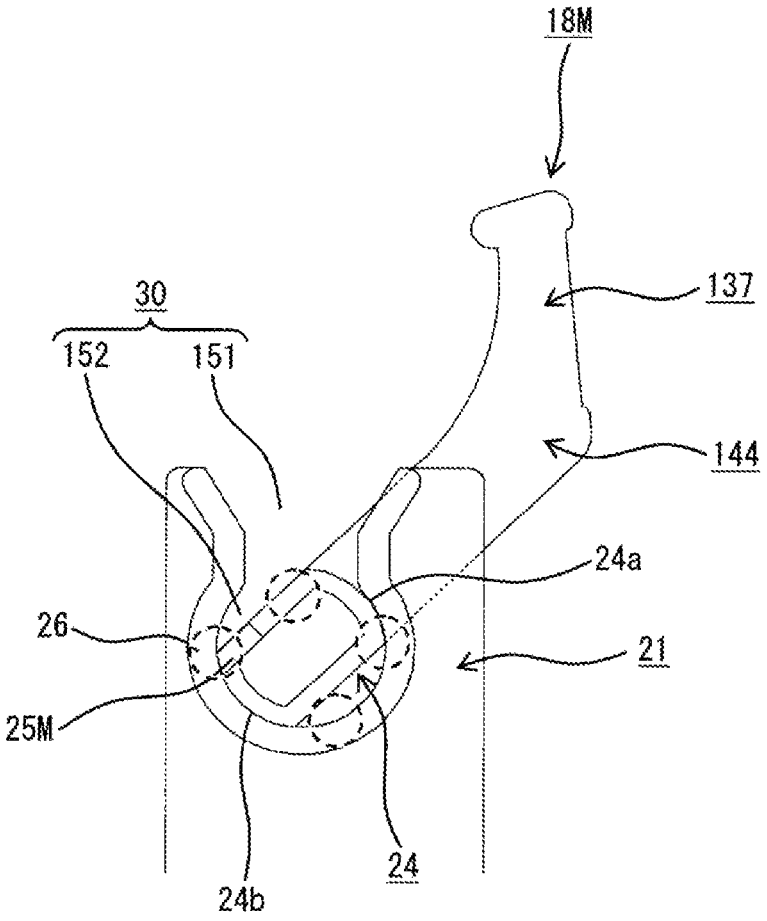
FIG. 10 is a diagram for explaining the locking state between the locking protrusion and the post when a magenta toner cartridge is attached to (or engaged with) the process part in the first embodiment of this invention.
Figure 11:
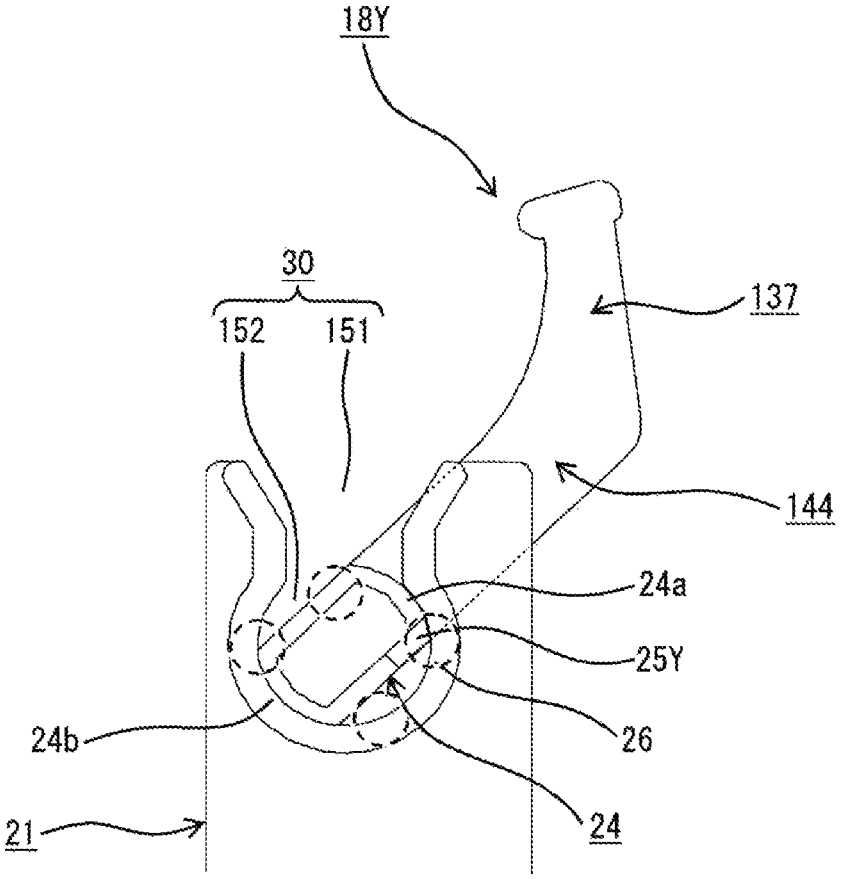
FIG. 11 is a diagram for explaining the locking state between the locking protrusion and the post when a yellow toner cartridge is attached to (or engaged with) the process part in the first embodiment of this invention.
Figure 12:
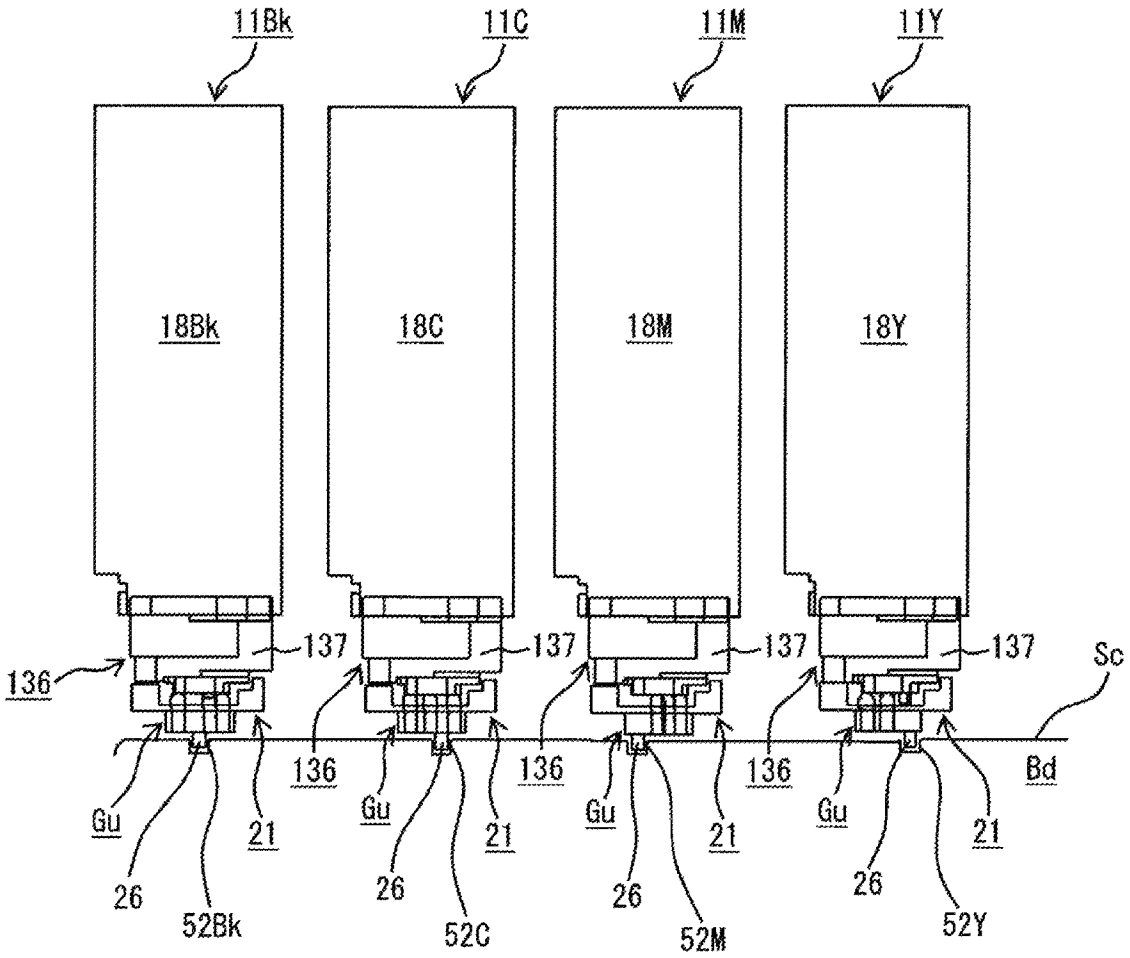
FIG. 12 is a diagram showing a state where the individual image forming units are attached to (or engaged with) the positions assigned by the toner color in the apparatus main body in the first embodiment of this invention.
Figure 13:
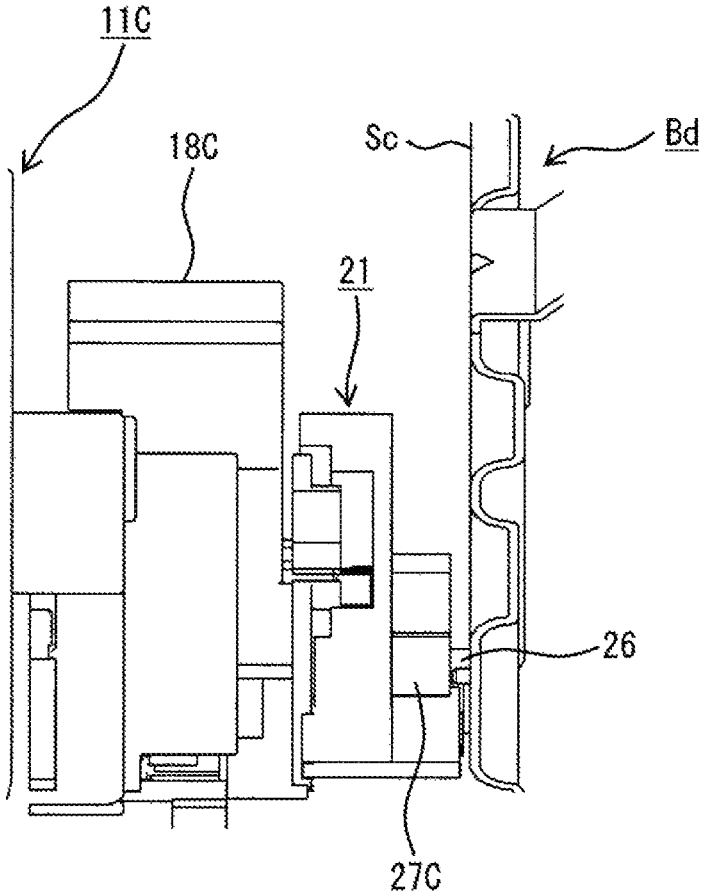
FIG. 13 is a diagram showing a state where one of the image forming units is not attached to the position assigned by the toner color in the apparatus main body in the first embodiment of this invention.

FIG. 1 is a diagram for explaining the state of the post when the yellow toner cartridge is attached to the process part in the first embodiment of this invention, FIG. 8 is a diagram for explaining the locking state of the locking protrusion and the post when the black toner cartridge is attached to the process part in the first embodiment of this invention, FIG. 9 is a diagram for explaining the locking state of the locking protrusion and the post when the cyan toner cartridge is attached to the process part in the first embodiment of this invention, FIG. 10 is a diagram for explaining the locking state of the locking protrusion and the post when the magenta toner cartridge is attached to the process part in the first embodiment of this invention, FIG. 11 is a diagram for explaining the locking state of the locking protrusion and the post when the yellow toner cartridge is attached to the process part in the first embodiment of this invention, FIG. 12 is a diagram showing a state where the individual image forming units are attached to the positions assigned by the toner color in the apparatus main body in the first embodiment of this invention, and FIG. 13 is a diagram showing a state where one of the image forming units is not attached to the position assigned by the toner color in the apparatus main body in the first embodiment of this invention.

In the figures, indicated as 18Bk, 18C, 18M, and 18Y are the toner cartridges, 21 is the process part, 27Bk, 27C, 27M, and 27Y are the guides, 137 is the lever, 144 is the arm part, 24 is a fitting projection, 26 is the post, 29 is the hole, 30 is the fitting recess, and 162 is the fitting projection guide.

The post 26 has a cut part P1 formed on a prescribed part for making the cross section into a D shape in order to prevent rotation in the circumferential direction or dropping onto the apparatus main body Bd side after being set into the hole 29. Also, a flat part Q1 is formed on the inner circumferential face of the hole 29 opposing the cut part P1.

In attaching the toner cartridge 18Bk, 18C, 18M, or 18Y to the process part 21, once the toner cartridge 18Bk, 18C, 18M, or 18Y is moved downwards and the fitting projection 24 is advanced into the fitting recess 30, as shown in FIG. 8, in the toner cartridge 18Bk, the locking protrusion 25Bk and the post 26 inside the guide 27Bk are locked, and the post 26 is protruded from the guide 27Bk, and as shown in FIG. 9, in the toner cartridge 18C, the locking protrusion 25C and the post 26 inside the guide 27C are locked, and the post 26 is protruded from the guide 27C.

At this time, in the toner cartridges 18M and 18Y, the locking protrusions 25M and 25Y are not locked with the post 26, and after moving the toner cartridge 18M or 18Y downwards and advancing the fitting projection 24 into the fitting recess 30, when the lever 137 is rotated, it is locked with the post 26. That is, once the lever 137 is rotated, the fitting projection 24 is rotated by having the outer circumferential faces of the sides 24*a* and 24*b* slide with the inner circumferential face of the fitting projection accommodating part 152, and as shown in FIG. 10, in the toner cartridge 18M, the locking protrusion 25M and the post 26 inside the guide 27M are locked. As the result, the post 26 is protruded from the guide 27M, and as shown in FIG. 11, in the toner cartridge 18Y, the locking projection 25Y and the post 26 inside the guide 27Y are locked, and as shown in FIG. 1, the post 26 is protruded from the guide 27Y.

On a face Sc opposing the individual image forming units 11Bk, 11C, 11M, and 11Y in the apparatus main body Bd, as shown in FIG. 12, lock grooves 52Bk, 52C, 52M, and 52Y as locked parts are formed in positions assigned to the image forming units 11Bk, 11C, 11M, and 11Y, respectively. Namely, only lock groove 52Bk is formed for unit 11Bk. Only lock groove 52C is for unit 11C. Only lock groove 52M is for unit 11M. Only lock groove 52Y is for unit 11Y.

Therefore, once the individual toner cartridges 18Bk, 18C, 18M, and 18Y are attached to the process parts 21, the posts 26 are protruded from the holes 29 of the individual guides 27Bk, 27C, 27M, and 27Y in the process parts 21 and are locked with the lock grooves 52Bk, 52C, 52M, and 52Y, therefore the image forming units 11Bk, 11C, 11M, and 11Y can be attached to the positions assigned by the color in the apparatus main body Bd.

For example, when one process part 21 has already functioned for black toner, black post 26Bk is expected to project. Accordingly, in such a process part, any other cartridges except for black toner cartridge 18Bk cannot be equipped properly. When trying to equip cyan toner cartridge 18C, it is found that the toner cartridge 18C cannot fit in the process part because lock groove 52C is not open. On the other hand, when trying to equip black toner cartridge 18Bk, the cartridge can fit in the process part because lock groove 52Bk is open. The detection part in the side plate (SL, SR) detects that the cartridge is equipped properly. Alternatively, another detection part may be provided to directly detect whether or not post 26 fits in corresponding groove 52.

That is, as shown in FIG. 13, in the image forming unit 11C for example among the image forming units, if the post 26 protruded from the hole 29 of the guide 27C of the process part 21 to which the toner cartridge 18C is attached and the face Sc in the apparatus main body Bd interfere with each other, it is evident that the image forming unit 11C is not attached to its assigned position in the apparatus main body Bd.

Next, explained is the state of the post 26 when the post 26 is protruded from the hole 29 of the guide 27Bk, 27C, 27M, or 27Y.

Figure 14:
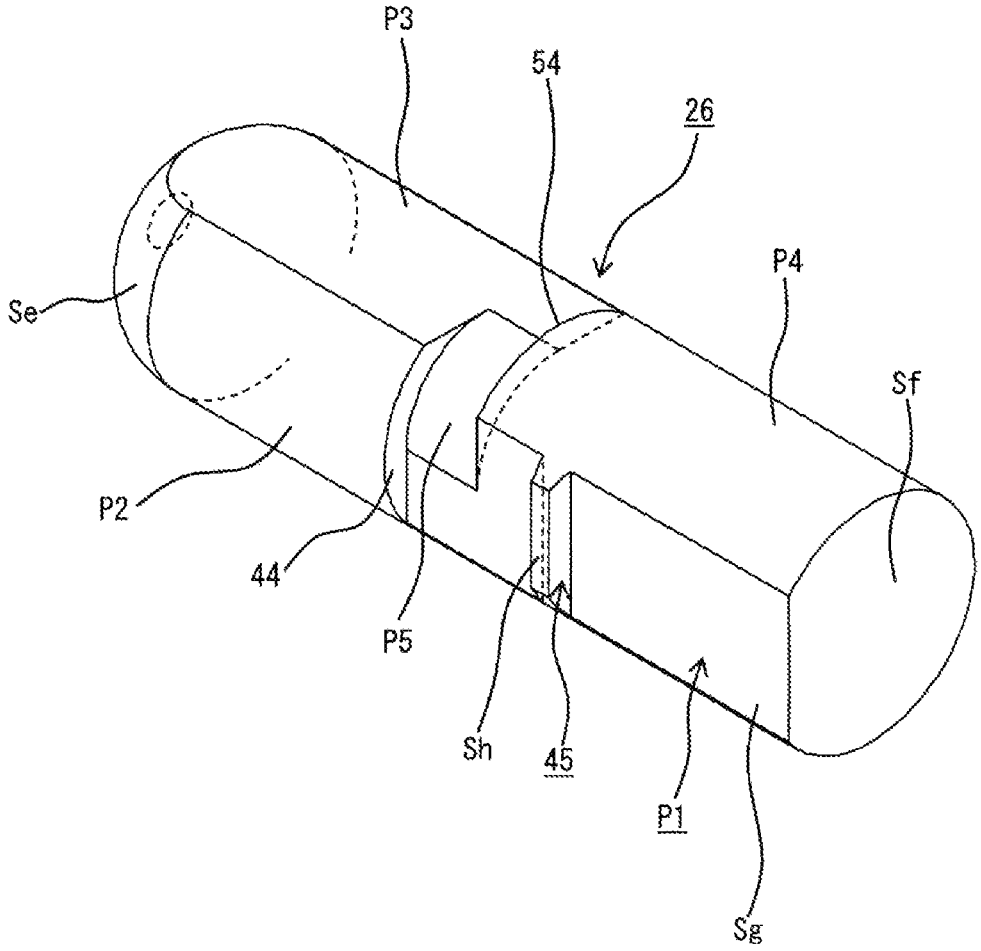
FIG. 14 is a perspective-view of the post in the first embodiment of this invention.
Figure 15:
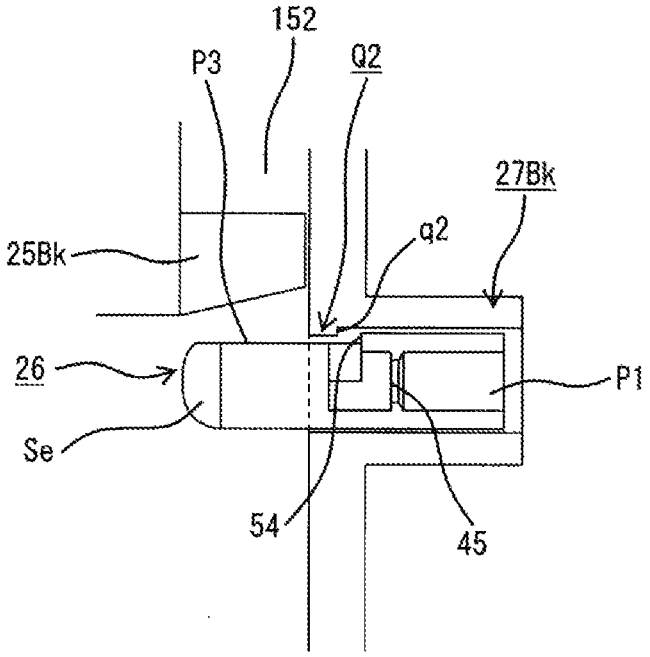
FIG. 15 is a first diagram showing a state where the post is placed in its initial position in the first embodiment of this invention.
Figure 16:
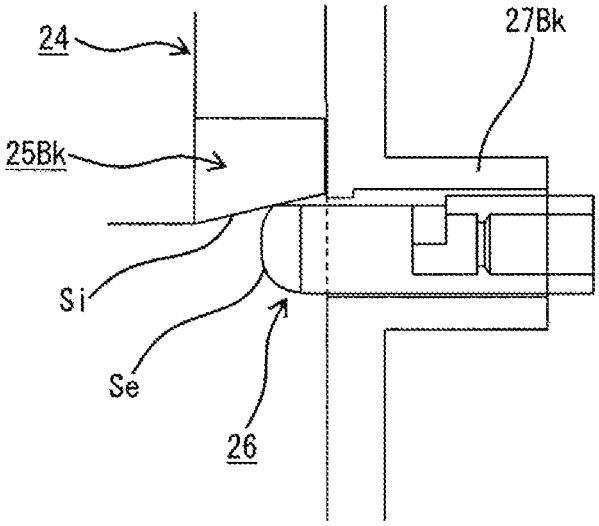
FIG. 16 is a diagram for explaining a process where the post is protruded in the first embodiment of this invention.
Figure 17:
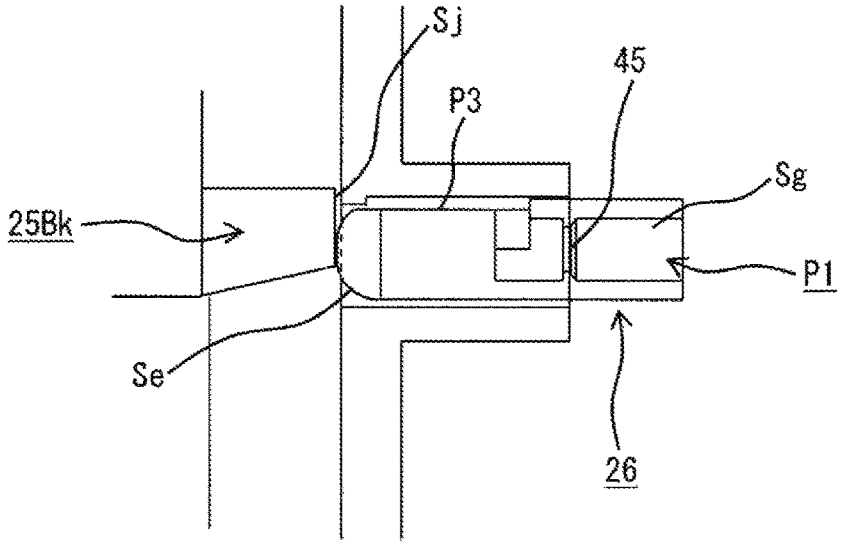
FIG. 17 is a first diagram showing a state where the post is protruded by the maximum amount in the first embodiment of this invention.
Figure 18:
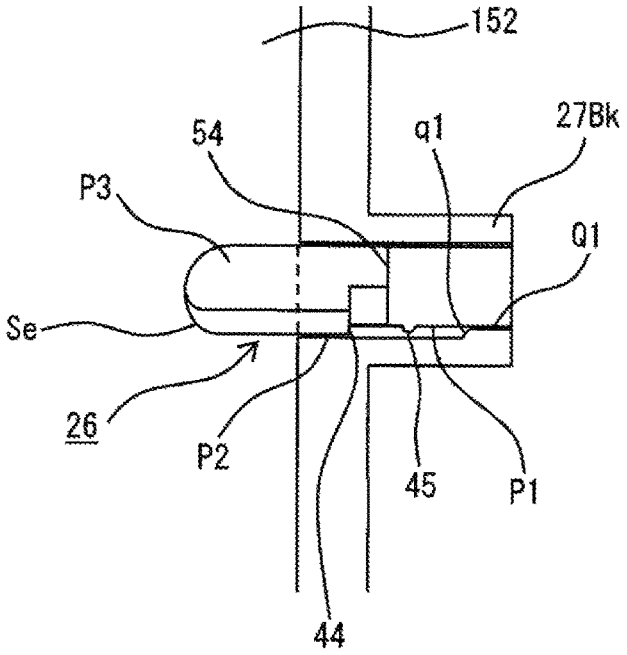
FIG. 18 is a second diagram showing a state where the post is placed in its initial position in the first embodiment of this invention.
Figure 19:
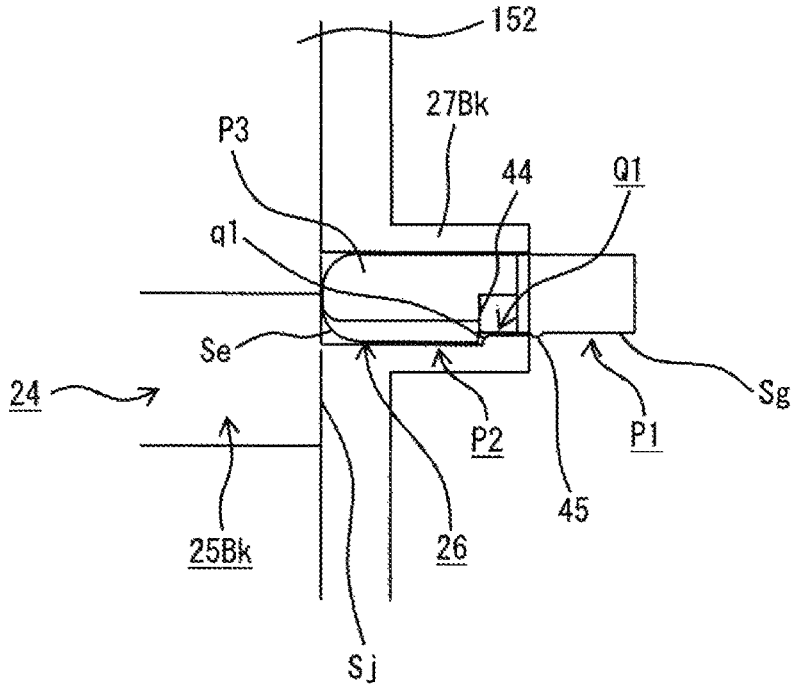
FIG. 19 is a second diagram showing a state where the post is protruded by the maximum amount in the first embodiment of this invention.

FIG. 14 is a perspective view of the post in the first embodiment of this invention, FIG. 15 is a first diagram showing a state where the post is placed in its initial position in the first embodiment of this invention, FIG. 16 is a diagram for explaining a process where the post is protruded in the first embodiment of this invention, FIG. 17 is a first diagram showing a state where the post is protruded by the maximum amount in the first embodiment of this invention, FIG. 18 is a second diagram showing a state where the post is placed in its initial position in the first embodiment of this invention, and FIG. 19 is a second diagram showing a state where the post is protruded by the maximum amount in the first embodiment of this invention. Note that shown in FIGS. 15-19 is the state of the post 26 inside the guide 27Bk.

In the figures, indicated as 26 is the post, and the post 26 is made of a solid rod-shape body, where formed on one end part is a lock face Se made of a nearly spherical convex surface for locking the locking protrusion 25Bk, 25C, 25M, or 25Y, and formed on the other end pat is a lock face Sf made of a flat surface for locking the lock groove 52Bk, 52C, 52M, or 52Y (FIG. 12) formed on the apparatus main body Bd with the post 26.

Also, the cut part P1 is formed over a prescribed distance from the lock face Sf on a prescribed part of the post 26, and the flat part Q1 is formed on an end part on the apparatus main body Bd side of the inner circumferential face of the hole 29. Then, a slip-off prevention part 44 as a first fall-off prevention part on the post 26 side is formed of a height difference with a columnar part P2 at an end part of the cut part P1 on the side of the toner cartridge 18Bk, 18C, 18M, or 18Y, and a slip-off prevention part q1 as a first fall-off prevention part on the hole 29 side is formed on an end part of the flat part Q1 on the side of the toner cartridge 18Bk, 18C, 18M, or 18Y.

Also, formed in a prescribed place on the cut part P1 on the lock face Sf side of the slip-off prevention part 44 is a claw part 45 as a positioning part for positioning the post 26 in the axial direction and preventing it from returning into the hole 29 when the post 26 has protruded by a prescribed amount from the hole 29. The claw part 45 is formed so as to protrude from a flat face Sg and become thinner toward its tip, and the tip is cut to provide an end face Sh that is parallel to the flat face Sg. Note that the height of the claw part 45 from the flat face Sg is set lower than the slip-off prevention part 44.

Further, after the post 26 is set into the hole 29, a cut part P3 is formed on a prescribed part of the post 26 for making its cross section into a D shape over a prescribed distance from the lock face Se so that the post 26 will not drop off onto the side of the toner cartridge 18Bk, 18C, 18M, or 18Y. Also, formed on an end part of the inner circumferential face of the hole 29 on the side of the toner cartridge 18Bk, 18C, 18M, or 18Y is a flat part Q2 opposing the cut part P3. Then, a slip-off prevention part 54 as a second fall-off prevention part on the post 26 side is formed of a height difference with the columnar part P4 at an end part of the cut part P3 on the apparatus main body Bd side, and a slip-off prevention part q2 as a second fall-off prevention part on the hole 29 side is formed on an end part of the flat part Q2 on the apparatus main body Bd side.

Also, the cut parts P1 and P3 are formed so that they form an angle of about 90° with each other in the circumferential direction and are overlapped with each other by a prescribed amount in the axial direction, and a cutout part P5 having an arc shape is formed between the cut parts P1 and P3 in the overlapped part.

The post 26 can be set in the hole 29 and placed in its initial position by inserting it with the cut part P1 opposing the flat part Q2, rotating it by about 90° when the cutout part P5 has reached the same position as the flat part Q2 in the axial direction, and having the cut part P3 oppose the flat part Q2.

For example, in the toner cartridge 18Bk, as shown in FIGS. 15 and 18, the post 26 in its initial position is not locked with the locking protrusion 25Bk or protruded to the apparatus main body Bd side but protruded into the fitting projection accommodating part 152. Note that once the post 26 is protruded further into the fitting projection accommodating part 152, because the slip-off prevention part 54 and the slip-off prevention part q2 are brought into contact, the post 26 is prevented from falling off onto the side of the toner cartridge 18Bk, 18C, 18M, or 18Y.

Then, once the toner cartridge 18Bk, 18C, 18M, or 18Y is moved downwards, in the toner cartridge 18Bk for example, as shown in FIG. 16, the post 26 is locked with the locking protrusion 25Bk, advanced, and protruded to the apparatus main body Bd side. Note that a prescribed tapered face Si is formed on the locking protrusion 25Bk, and once the tapered face Si and the lock face Se come into contact, a force that moves the locking protrusion 25Bk downwards is converted to a force that advances the post 26.

Once the toner cartridge 18Bk, 18C, 18M, or 18Y is moved further downwards, in the toner cartridge 18Bk for example, as shown in FIGS. 17 and 19, an end face Sj of the locking protrusion 25Bk and the lock face Se of the post 26 are brought into contact, and the post 26 is protruded by the maximum amount to the apparatus main body Bd side. At this time, as mentioned above, because the claw part 45 is formed so as to protrude from the flat face Sg of the cut part P1 and become thinner toward its tip and has its tip cut, it passes through the flat part Q1 of the hole 29 in a deformed state, and is protruded to the apparatus main body Bd side in a restored state. Thereby, the post 26 is prevented from returning into the hole 29. Also, the slip-off prevention part 44 is brought into contact with the slip-off prevention part q1, preventing the post 26 from falling off the hole 29.

Note that although the claw part 45 rides over the slip-off prevention part q1 in a deformed state because the slip-off prevention part q1 of the flat part Q1 is formed of a tapered surface, it does not ride over the slip-off prevention part q1 because the slip-off prevention part 44 is formed higher than the claw part 45.

In this manner, in this embodiment, the process part 21 shared by the individual toner cartridges 18Bk, 18C, 18M, and 18Y is provided with the post guide unit Gu in a place opposing the toner cartridge 18Bk, 18C, 18M, or 18Y, and the post guide unit Gu is provided with the post 26 that is locked with the locking protrusion 25Bk, 25C, 25M, or 25Y and is protruded to the apparatus main body Bd side from the post guide unit Gu, therefore by locking the post 26 with the lock groove 52Bk, 52C, 52M, or 52Y formed on the apparatus main body Bd, the image forming unit 11Bk, 11C, 11M, or 11Y can be precisely attached to the position assigned by the color in the apparatus main body Bd.

Then, because the process part 21 can be shared by the multiple toner cartridges 18Bk, 18C, 18M, and 18Y, there is no need to form the process part 21 separately for the individual image forming units 11Bk, 11C, 11M, and 11Y, and there is no need to manage the image forming units 11Bk, 11C, 11M, and 11Y, thereby the cost of the printer 10 can be lowered.

Next, explained is the second embodiment of this invention where each toner cartridge is moved horizontally to be attached to the process part 21. Note that those having the same structures as in the first embodiment are given the same codes, and the efficacy of the first embodiment is invoked as the efficacy of the invention due to having the same structure.

Figure 20:
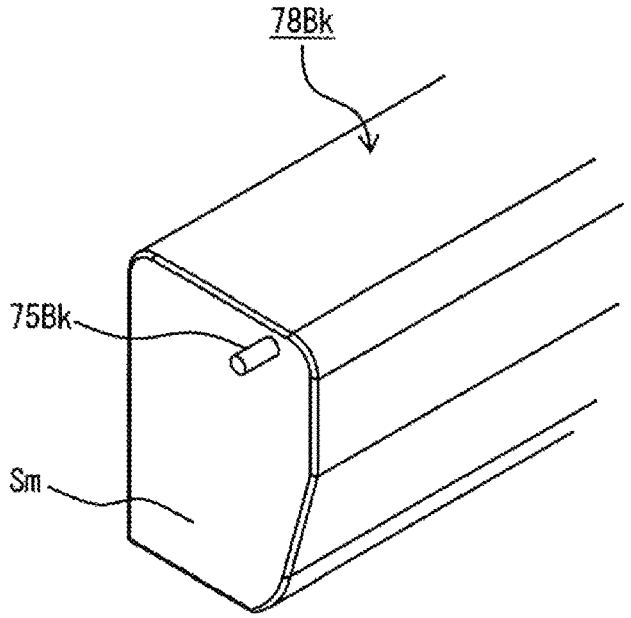
FIG. 20 is a perspective view of a black toner cartridge in the second embodiment of this invention.
Figure 21:
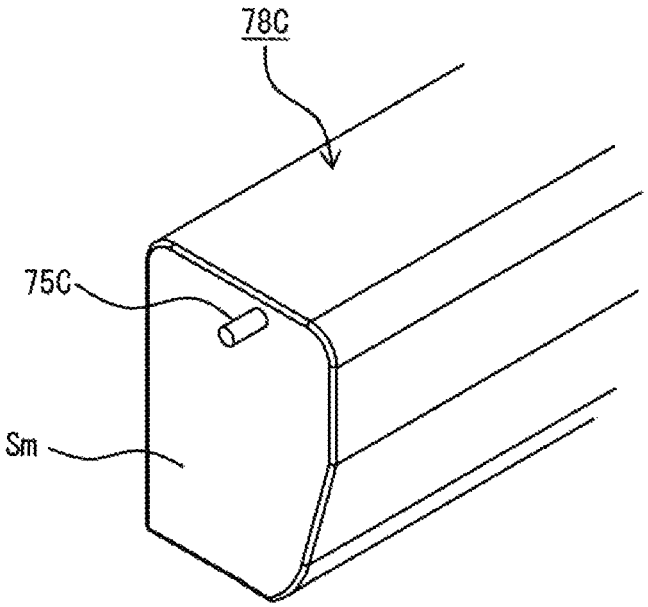
FIG. 21 is a perspective view of a cyan toner cartridge in the second embodiment of this invention.
Figure 22:
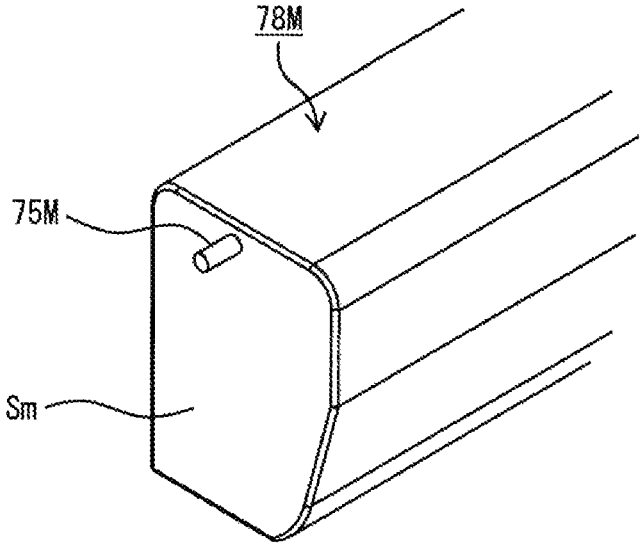
FIG. 22 is a perspective view of a magenta toner cartridge in the second embodiment of this invention.
Figure 23:
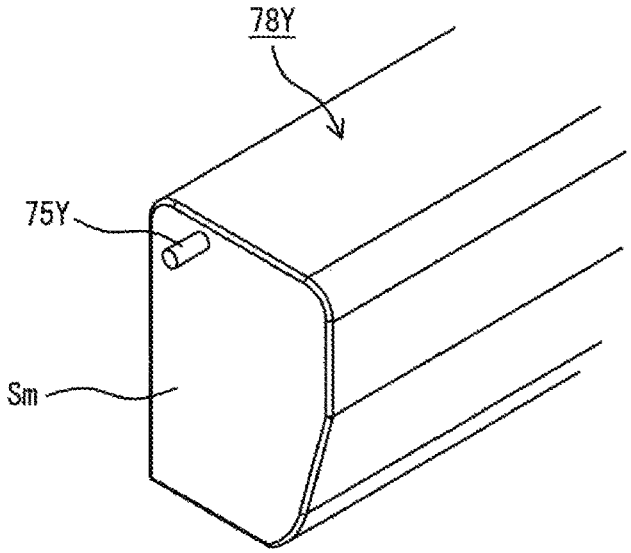
FIG. 23 is a perspective view of a yellow toner cartridge in the second embodiment of this invention.
Figure 24:
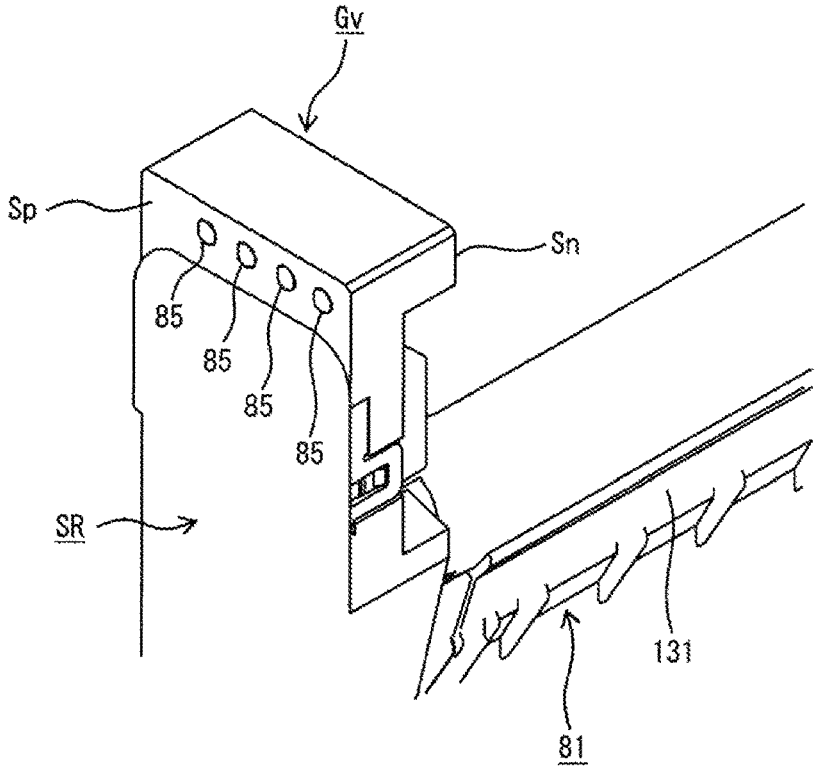
FIG. 24 is a main part perspective view of a process part in the second embodiment of this invention.
Figure 25:
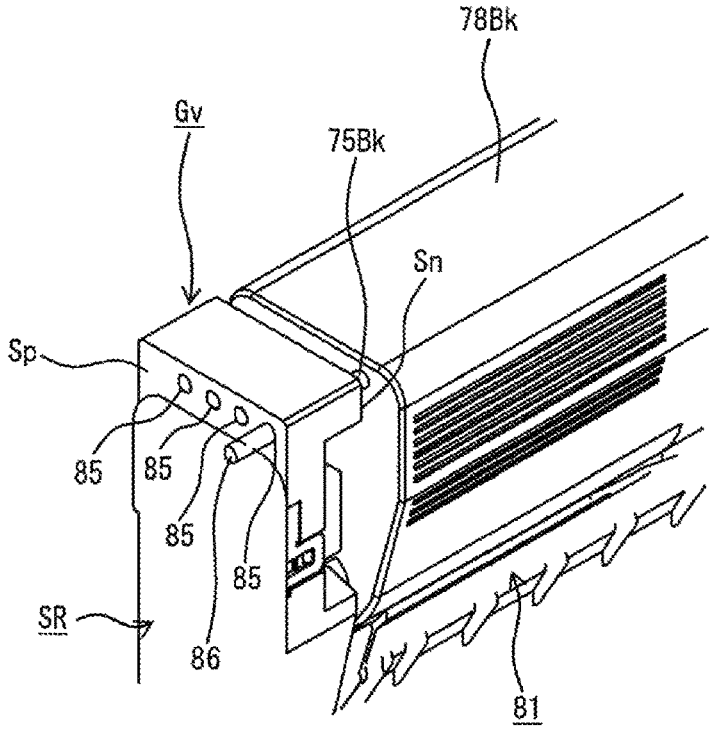
FIG. 25 is a diagram showing a state when the black toner cartridge is attached to (or engaged with) the process part in the second embodiment of this invention.

FIG. 20 is a perspective view of a black toner cartridge in the second embodiment of this invention, FIG. 21 is a perspective view of a cyan toner cartridge in the second embodiment of this invention, FIG. 22 is a perspective view of a magenta toner cartridge in the second embodiment of this invention, FIG. 23 is a perspective view of a yellow toner cartridge in the second embodiment of this invention, FIG. 24 is a main part perspective view of a process part in the second embodiment of this invention, and FIG. 25 is a diagram showing a state when the black toner cartridge is attached to the process part in the second embodiment of this invention.

In the figures, indicated as 81 is the process part, 78Bk, 78C, 78M, and 78Y are the toner cartridges as developer containing parts for containing toners as individual color developers, each of which is detachably attached to the process part 81, and SR is a side plate formed standing upwards at one end part of a process part main body 131 of the process part 81, in this embodiment at the right-side end part when facing a fuser 31 (FIG. 2) as a fuser device. The process part 81 is shared by the toner cartridges 78Bk, 78C, 78M, and 78Y.

By attaching the toner cartridge 78Bk, 78C, 78M, or 78Y to the process part 81, an image forming unit 11Bk, 11C, 11M, or 11Y is formed, respectively. Therefore, in the toner cartridge 78Bk, 78C, 78M, or 78Y, a locking protrusion 75Bk, 75C, 75M, or 75Y as a locking part is formed protruding, respectively, on each different position in the vicinity of the upper end of a side face Sm opposing the side plate SR.

Also, a post guide unit Gv as an intermediate locking member guide part is arranged opposing the side face Sm in a place opposing the toner cartridge 78Bk, 78C, 78M, or 78Y in the process part 81, in this embodiment, in the vicinity of the upper end of the side plate SR. The post guide unit Gv is made of a block having an L shape, where four holes 85 corresponding to the locking protrusions 75Bk, 75C, 75M, and 75Y are formed penetrating from the side of a face Sn opposing the side face Sm to the side of a face Sp opposing the apparatus main body Bd (FIG. 12), and a post 86 as an intermediate locking member is arranged in a manner allowing free advance and retreat inside each of the holes 85.

Then, once the toner cartridge 78Bk, 78C, 78M, or 78Y is attached to the process part 81, each post 86 is protruded toward the apparatus main body Bd.

In attaching the toner cartridge 78Bk, 78C, 78M, or 78Y to the process part 81, once the toner cartridge 78Bk, 78C, 78M, or 78Y is moved in the horizontal direction (or the same direction as pivot axis PA extending) to bring the side face Sm and the face Sn into contact, in the toner cartridge 78Bk for example, the locking protrusion 75Bk is advanced into the hole 85 and locked with the post 86 inside the hole 85, and the post 86 is protruded from the hole 85.

In this manner, because the post 86 is protruded from the hole 85 in the process part 81 once the toner cartridge 78Bk, 78C, 78M, or 78Y is attached to the process part 81, by forming the lock grooves 52Bk, 52C, 52M, and 52Y on the face Sc opposing the individual image forming units 11Bk, 11C, 11M, and 11Y in the apparatus main body Bd in positions assigned to the individual image forming units 11Bk, 11C, 11M, and 11Y, respectively, the image forming units 11Bk, 11C, 11M, and 11Y can be attached to the positions assigned by the color in the apparatus main body Bd. Such proper attachments are detected by the detection part discussed in the previous embodiment.

Next, explained is the state of the post 86 when the post 86 is protruded from the hole 85.

Figure 26:
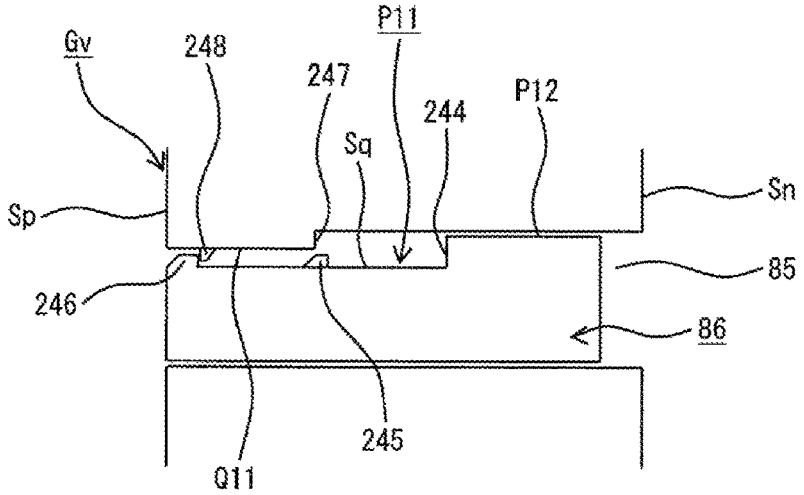
FIG. 26 is a first diagram for explaining a process where a post is protruded in the second embodiment of this invention.
Figure 27:
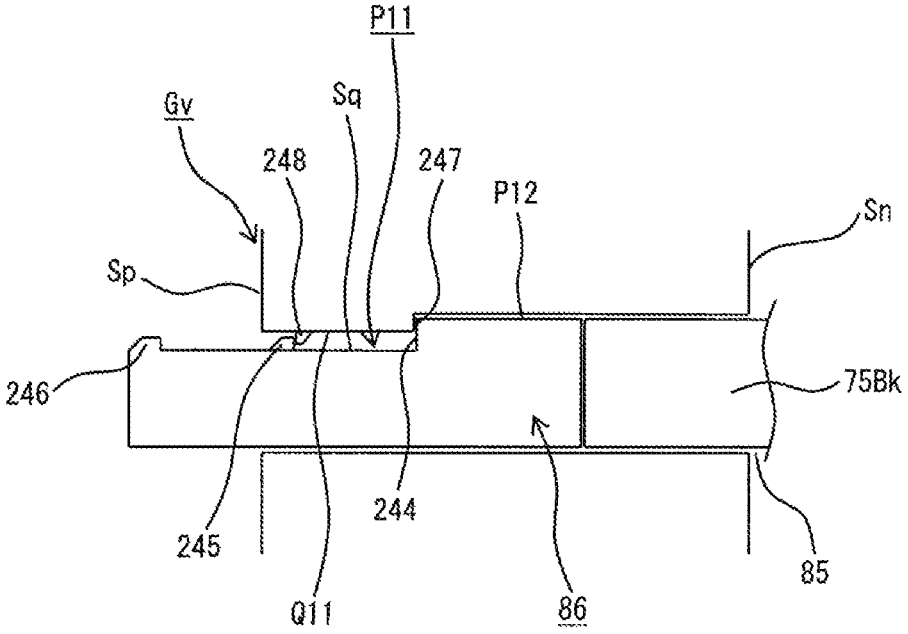
FIG. 27 is a second diagram for explaining a process where the post is protruded in the second embodiment of this invention.

FIG. 26 is a first diagram for explaining a process where the post is protruded in the second embodiment of this invention, and FIG. 27 is a second diagram for explaining a process where the post is protruded in the second embodiment of this invention.

In this case, a cut part P11 is formed on a prescribed part of the post 86 for making the cross section into a D shape so that the post 86 can be positioned at a prescribed position in the circumferential direction of the post 86. Also, in the hole 85 a flat part Q11 is formed opposing the cut part P11.

Then, formed at an end part of the cut part P11 of the post 86 on the side of the toner cartridge 78Bk, 78C, 78M, or 78Y is an arc-shape slip-off prevention part 244 as a first fall-off prevention part on the post 86 side for preventing the post 86 from falling off when protruded from the hole 85 to the apparatus main body Bd side, and formed at an end part of the flat part Q11 on the side of the toner cartridge 78Bk, 78C, 78M, or 78Y is a slip-off prevention part 247 as a first fall-off prevention part on the hole 85 side to be engaged with the slip-off prevention part 244.

Also, formed protruding from a flat face Sq of the cut part P11 in a prescribed place on the apparatus main body Bd side of the slip-off prevention part 244 is a claw part 245 as a positioning part for positioning the post 86 and preventing it from returning into the hole 85 when the post 86 has protruded by a prescribed amount from the hole 85. The claw part 245 is formed so as to protrude from the flat face Sq and become thinner toward its tip. Further, formed protruding from the flat face Sq at an end part of the post 86 on the apparatus main body Bd side is a front end projection 246 as a second fall-off prevention part on the post 86 side.

Then, formed on the flat part Q11 slightly on the side of the toner cartridge 78Bk, 78C, 78M, or 78Y from an end part of the post 86 on the apparatus main body Bd side is a claw part 248 as a second fall-off prevention part on the hole 85 side, and as shown in FIG. 26, it is engaged with the front end projection 246 and prevents the post 86 from retreating from its initial position shown in FIG. 26 and falling off onto the side of the toner cartridge 78Bk, 78C, 78M, or 78Y.

Once the toner cartridge 78Bk, 78C, 78M, or 78Y is attached to the process part 81, in the toner cartridge 78Bk for example, as shown in FIG. 27, the locking protrusion 75Bk advances into the hole 85 and protrudes the post 86 from the hole 85.

At this time, the claw part 245 rides over the claw part 248 in a deformed state and is restored. Therefore, the post 86 is prevented from returning into the hole 85.

In this manner, in this embodiment, because each of the locking protrusions 75Bk, 75C, 75M, and 75Y formed on the side face Sm of each of the toner cartridges 78Bk, 78C, 78M, and 78Y, respectively, is locked with the post 86 arranged inside each of the holes 85, the structures of the toner cartridges 78Bk, 78C, 78M, and 78Y and the post 86 can be simplified.

Therefore, the cost of the printer 10 can be lowered.

Although explained in the embodiments mentioned above is the printer 10, this invention can be applied to other image forming apparatuses such as a copier, a facsimile machine, and a multifunction machine.

Note that this invention is not limited to the embodiments mentioned above, but various kinds of modifications are possible based on the purport of this invention and are not excluded from the scope of this invention.

In the above embodiment, a main controller of the apparatus proceeds in ordinary image forming processes after cartridges containing different color toners are correctly attached to corresponding process parts. The main controller is composed with conventional structure like a processor, memory etc.

What is claimed is:

1. A misattachment prevention device for an image forming unit, comprising:

(a) multiple developer containing parts that contain individual color developers, each of the developer containing parts containing a different color developer from the other developer containing parts, and (b) process parts each of which is capable to be engaged with any of the developer containing parts, and forms the image forming unit for an individual color by having one of the developer containing parts engaged, wherein (c) each of the process parts is provided with an intermediate locking member guide part in a place opposing the one of the developer containing parts, and (d) the intermediate locking member guide part is provided with an intermediate locking member that is locked with a locking part formed on the one of the individual developer containing parts, protruded from the intermediate locking member guide part to a side of an apparatus main body, and locked with a locked part formed on the apparatus main body, and the locking part is formed on a lever holding part that holds a lever, which is used to pivot the developer containing par around a pivot axis thereof to engage with the process part, and locked with the intermediate locking member by moving the one of the developer containing parts toward a direction in which the intermediate locking member guide part guides the developer containing parts to a position where to be engaged.

2. The misattachment prevention device according to claim 1, wherein the intermediate locking member is arranged in a manner allowing free advance and retreat inside a hole formed on the intermediate locking member guide part.

3. The misattachment prevention device according to claim 2, wherein the process part is provided with a fall-off prevention part that prevents the intermediate locking member from falling off the hole.

4. The misattachment prevention device according to claim 2, wherein the intermediate locking member is provided with a fall-off prevention part that prevents falling off the hole.

5. An image forming apparatus provided with the misattachment prevention device according to claim 1.

6. A misattachment prevention device for an image forming unit, comprising:

(a) multiple developer containing parts that contain individual color developers, each of the developer containing parts containing a different color developer from the other developer containing parts, and (b) process parts each of which is capable to be engaged with any of the developer containing parts, and forms the image forming unit for an individual color by having one of the developer containing parts engaged, wherein (c) each of the process parts is provided with an intermediate locking member guide part in a place opposing the one of the developer containing parts, and (d) the intermediate locking member guide part is provided with an intermediate locking member that is locked with a locking art formed on the one of the individual developer containing parts, protruded from the intermediate locking member guide part to a side of an apparatus main body, and locked with a locked part formed on the apparatus main body, the locking part is locked with the intermediate locking member by engaging the one of the developer containing parts to the process part, each of the developer containing parts is composed with an inner case that is pivotable around a pivot axis, and the intermediate locking member protrudes along the pivot axis.

7. The misattachment prevention device according to claim 6, wherein the intermediate locking member is arranged in a manner allowing free advance and retreat inside a hole formed on the intermediate locking member guide part.

8. The misattachment prevention device according to claim 7, wherein the process part is provided with a fall-off prevention part that prevents the intermediate locking member from falling off the hole.

9. The misattachment prevention device according to claim 7, wherein the intermediate locking member is provided with a fall-off prevention part that prevents falling off the hole.

10. The misattachment prevention device according to claim 6, wherein the locking part is formed on a side face of the one of the developer containing parts and locked with the intermediate locking member by moving the one of the developer containing parts in a horizontal direction, each of the developer containing parts is composed with an inner case that is pivotable around a pivot axis, the side face being defined to be perpendicular to the pivot axis and the horizontal direction being defined as extending along the pivot axis.

11. An image forming apparatus provided with the misattachment prevention device according to claim 6.

12. An image forming unit, comprising:

a developer containing part that contains a developer for an image forming process, and a process part to which the developer containing part is inserted such that the developer containing part is secured at a feeding position where the developer is fed out of the developer containing part, wherein the developer containing part is provided with a locking part that is engaged with the process part when the developer containing part is secured at the feeding position, the process part is provided with a plurality of intermediate locking member guide parts, each of which includes an intermediate locking member that is movable inside thereof such that the intermediate locking member reciprocates between an housing position at which the intermediate locking member is close to the developer containing part and a protruding position at which the intermediate locking member is distant from the developer containing part, and the intermediate locking member guide parts being located at different positions on the process part, the locking part is positioned to correspond to one of the intermediate locking member guide parts such that, when the developer containing part is secured at the feeding position, the locking part is engaged with the one of the intermediate locking member guide parts, which is defined as a corresponding guide part, when engaging the corresponding guide part, the locking part pushes the intermediate locking member of the corresponding guide part toward the protruding position such that at least a portion of the intermediate locking member protrudes from the corresponding guide part.

13. The image forming unit according to claim 12, wherein the corresponding guide part has a chamber extending between the housing position and the protruding position, and the locking part is formed to fit in the chamber such that the locking part is slidable between the housing position and the protruding position.

14. The image forming unit according to claim 13, wherein the corresponding guide part has a fall-off prevention part that prevents the intermediate locking member from falling out of the chamber.

15. The image forming unit according to claim 13, wherein the intermediate locking member of the corresponding guide part has a fall-off prevention part that prevents the intermediate locking member from falling out of the chamber.

16. The image forming unit according to claim 12, wherein the developer containing part is provided with an outer case and an inner case that is arranged inside the outer case, the inner case being rotatable around a rotation axis inside the outer case, the intermediate locking member of the corresponding guide part is configured to reciprocate along the rotation axis.

17. The image forming unit according to claim 16, wherein the developer containing part is provided further with an operation lever that is used to rotate the inner case and a lever holding part that is used to hold the operation lever, the locking member is formed on the lever holding part, in correspondence with an insertion of the developer containing part to the process part, the locking member makes a contact with the intermediate locking member, protruding the intermediate locking member out of the corresponding guide part.

18. An image forming apparatus, comprising:

the image forming unit according to claim 12, an apparatus body to which the image forming unit is inserted, wherein the apparatus body is provided with an engaged part that engages with the intermediate locking member of the corresponding guide part.

19. The image forming apparatus according to claim 18, wherein the apparatus body is further provided with other engaged parts that are arranged at positions corresponding to other intermediate locking members of other intermediate locking member guide parts than the corresponding guide part such that each of the engaged parts corresponds to one of the intermediate locking members.

20. The image forming apparatus according to claim 18, further comprising:

another developer containing part that contains a different developer from the developer contained the developer containing part, herein the developer containing part and the another developer containing part being respectively defined as first and second developer containing parts, wherein the locking member of the first developer containing part is arranged at a first position, being defined as a first locking member, and the locking member of the second developer containing part is arranged at a second position, which is different from the first position, being defined as a second locking member, the intermediate locking members and the intermediate locking member guide parts of the process part are configured to be engaged with any of the first and second locking members, when the first developer containing part is inserted to the process unit, the first locking member is engaged with one of the intermediate locking member guide parts, which is defined as a first guide part, protruding the intermediate locking member of the first guide part, and when the second developer containing part is inserted to the process unit, the second locking member is engaged with another of the intermediate locking member guide parts, which is defined as a second guide part, protruding the intermediate locking member of the second guide part.

* * * * *